United States Patent [19]

Matsumoto et al.

[11] 4,314,018

[45] Feb. 2, 1982

[54] CLEANING PROCESS FOR AN ELECTROSTATIC COPYING APPARATUS

[75] Inventors: Shoji Matsumoto, Neyagawa; Toshikazu Matsui, Kishiwada; Toshimitsu Ikeda, Higashiosaka; Nobuhiko Kozuka, Suita; Hitoshi Nishihama, Uji; Tatsuo Aizawa, Osaka, all of Japan

[73] Assignee: Mita Industrial Company, Ltd., Osaka, Japan

[21] Appl. No.: 88,654

[22] Filed: Oct. 26, 1979

Related U.S. Application Data

[62] Division of Ser. No. 895,465, Apr. 11, 1978, Pat. No. 4,254,202.

[51] Int. Cl.[3] ..... G03G 13/22; G03G 21/00

[52] U.S. Cl. ..... 430/125; 355/15

[58] Field of Search ..... 355/3 R, 3 DD, 15; 430/125

[56] References Cited

U.S. PATENT DOCUMENTS 4,110,034 8/1978 Suzuki ..... 355/15

4,142,165 2/1979 Miyakawa et al. ..... 355/15 X

FOREIGN PATENT DOCUMENTS 52-17831 2/1977 Japan ..... 355/15

*Primary Examiner*—Fred L. Braun

*Attorney, Agent, or Firm*—Wenderoth, Lind & Ponack

[57] ABSTRACT

An electrophotograhic copying process forms an electrostatic latent image on the surface of a photosensitive member, developes the image by applying a monocomponent developer to the latent image to form a toner image, transfers the thus formed toner image by contacting a receptor sheet with the photosensitive member to transfer the toner image to the surface of the receptor sheet, fixes the toner image onto the surface of the receptor sheet, eliminates electrostatic charge from the photosensitive member by irradiating the surface of the photosensitive member with an electrostatic eliminating lamp after the toner image has been transferred to the receptor sheet, and cleans the surface of the photosensitive member by removing the developer remaining on the surface thereof. A developer-holding member holds the same kind of developer as used in the developing step on the surface of said developer-holding member by a stationary magnet disposed within the developer-holding member, and the surface of the developer-holding member is moved in a direction opposite to the direction of movement of the surface of the photosensitive member while contacting the two surfaces through the layer of the developer to mechanically brush the surface of the photosensitive member by the layer of the developer. The magnet having a plurality of poles, and the magnetic pole which is located closest to a position at which the surface of the developer-holding member is closest to the surface of the photosensitive member is downstream in the rotation direction of the developer-holding member by a certain angle with respect to the position at which the two surfaces are closest to each other.

3 Claims, 29 Drawing Figures

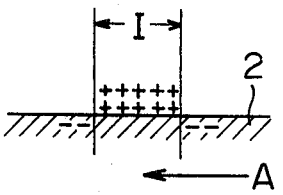
Fig. 1-a
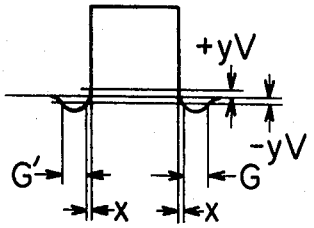
Fig. 1-b
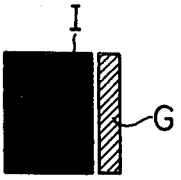
Fig. 1-c

CLEANING PROCESS FOR AN ELECTROSTATIC COPYING APPARATUS

This application is a Division of application Ser. No. 895,465, filed Apr. 11, 1978, now U.S. Pat. No. 4,254,202.

BACKGROUND OF THE INVENTION

This invention relates to a process and an apparatus for electrostatic copying. More specifically, it relates to an electrostatic copying process which comprises a step of forming an electrostatic latent image corresponding to an original on a photosensitive member having a photoconductive layer and a developing step for rendering the latent image visible, and to an electrostatic copying apparatus for performing the electrostatic copying process.

Generally, electrostatic copying processes for forming a copied image corresponding to an original include a step of forming an electrostatic latent image corresponding to an original on a photosensitive member having a photoconductive layer, and a developing step for rendering the electrostatic latent image visible. The electrostatic latent image-forming step comprises a step of applying an electrostatic charge to the photosensitive member and a step of projecting the original image on the photosensitive member. The electrostatic latent image formed on the photosensitive member in the latent image-forming step is rendered visible by developing it either directly or after transferring it to a suitable material (latent image transfer). The developing step can be performed by various methods, but generally, it is performed by applying a fine powdery developer (toner) to the electrostatic latent image.

Research and development have recently been done on various aspects of these electrostatic copying processes, especially the electrostatic latent image-forming step and the developing step, and various improvements have been suggested. None of them, however, are entirely satisfactory, and various problems still exist which have to be solved to obtain images of better quality. In particular, the developing step performed by applying a fine powdery developer to the electrostatic latent image poses many problems which are described in detail below with reference to the accompanying drawings.

Extensive research and development have also been undertaken in recent years on the electrostatic copying apparatus for the performance of these electrostatic copying processes, and various improvements have been suggested. These apparatuses, however, have to be improved further to obtain better copied images, permit easier operation and maintenance, and to render them simpler in structure and lower in price.

OBJECTS OF THE INVENTION

It is a primary object of this invention to provide an electrostatic copying process in which a developing step to be performed by applying a fine powdery developer to an electrostatic latent image is improved.

Another object of this invention is to provide an electrostatic copying apparatus which permits easier operation and maintenance, is simpler in structure and lower in price, and can form better copied images than known electrostatic copying apparatuses.

Other objects and advantages of the invention will become apparent from the following description.

BRIEF DESCRIPTION OF THE ACCOMPANYING DRAWINGS

FIGS. 1-*a* to 1-*c* are diagrammatic views for illustrating a ghost image which occurs during development in a known rolling contact method;

Figure 8:
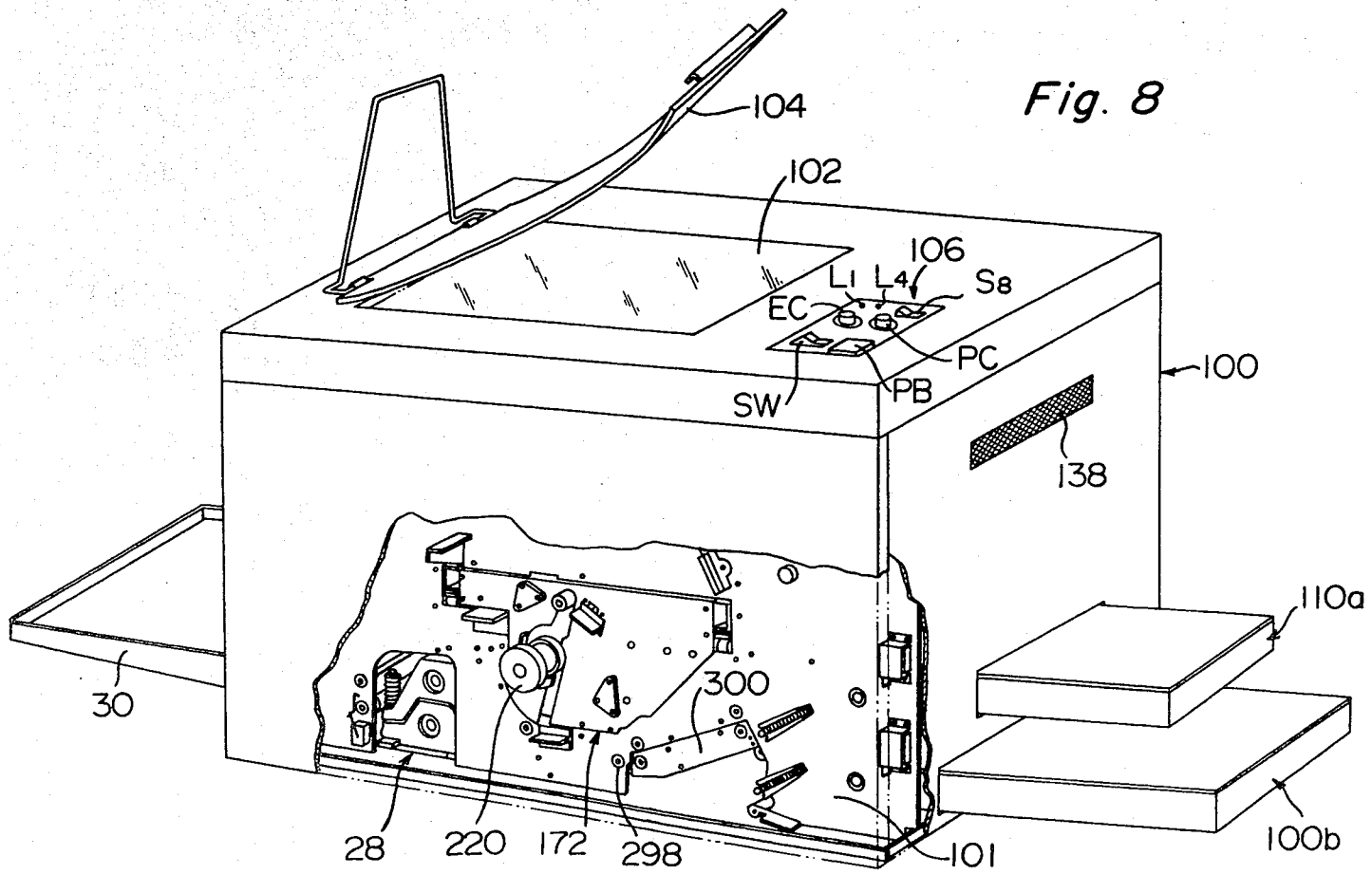
FIG. 8 is a perspective view, partly broken away, of the electrostatic copying apparatus in accordance with this invention.
Figure 13:
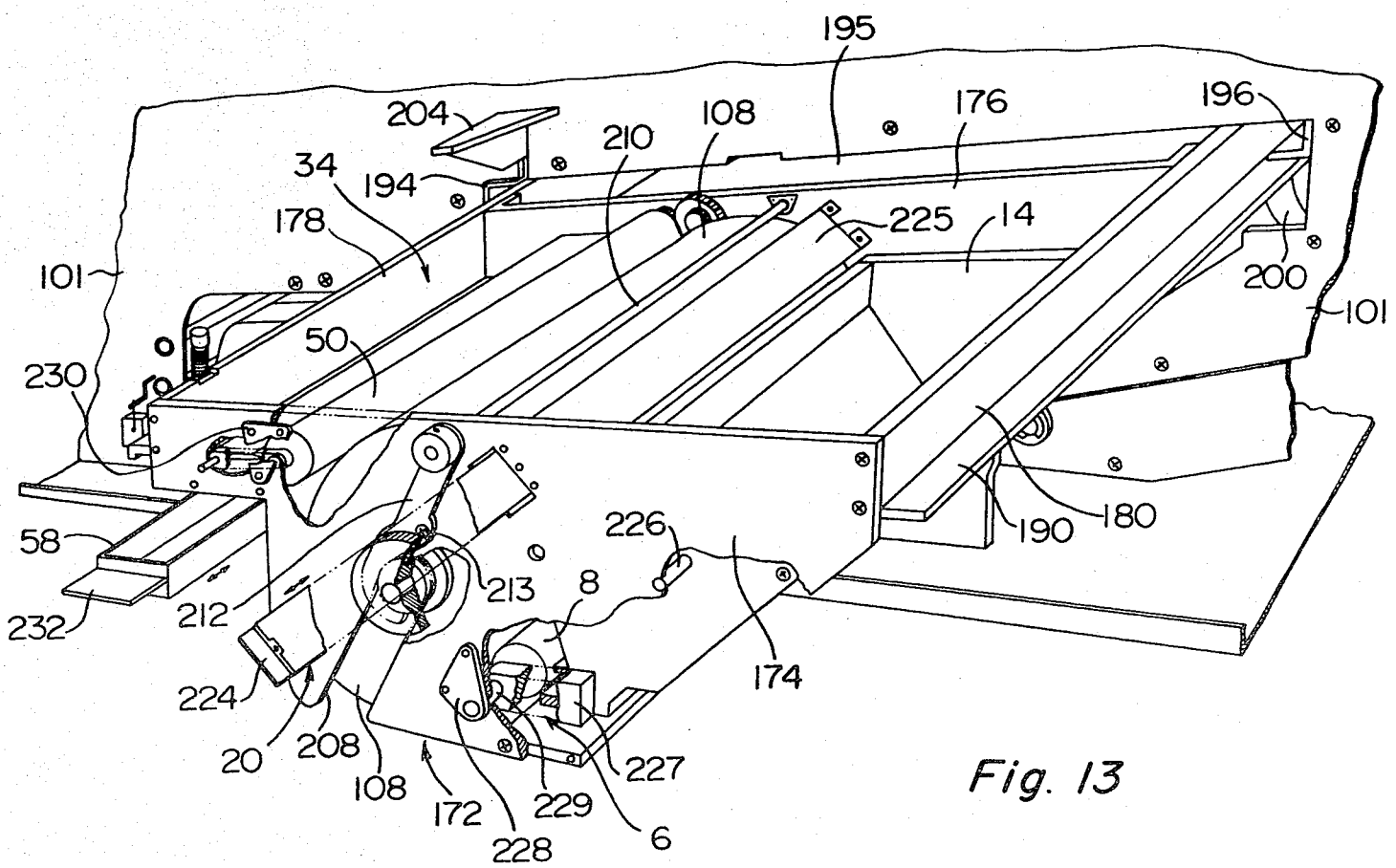
FIG. 13 is a partial perspective view showing the state of a lower part of the electrostatic copying apparatus shown in FIG. 8, in which a support has been partly pulled out.
Figures 4, 13:
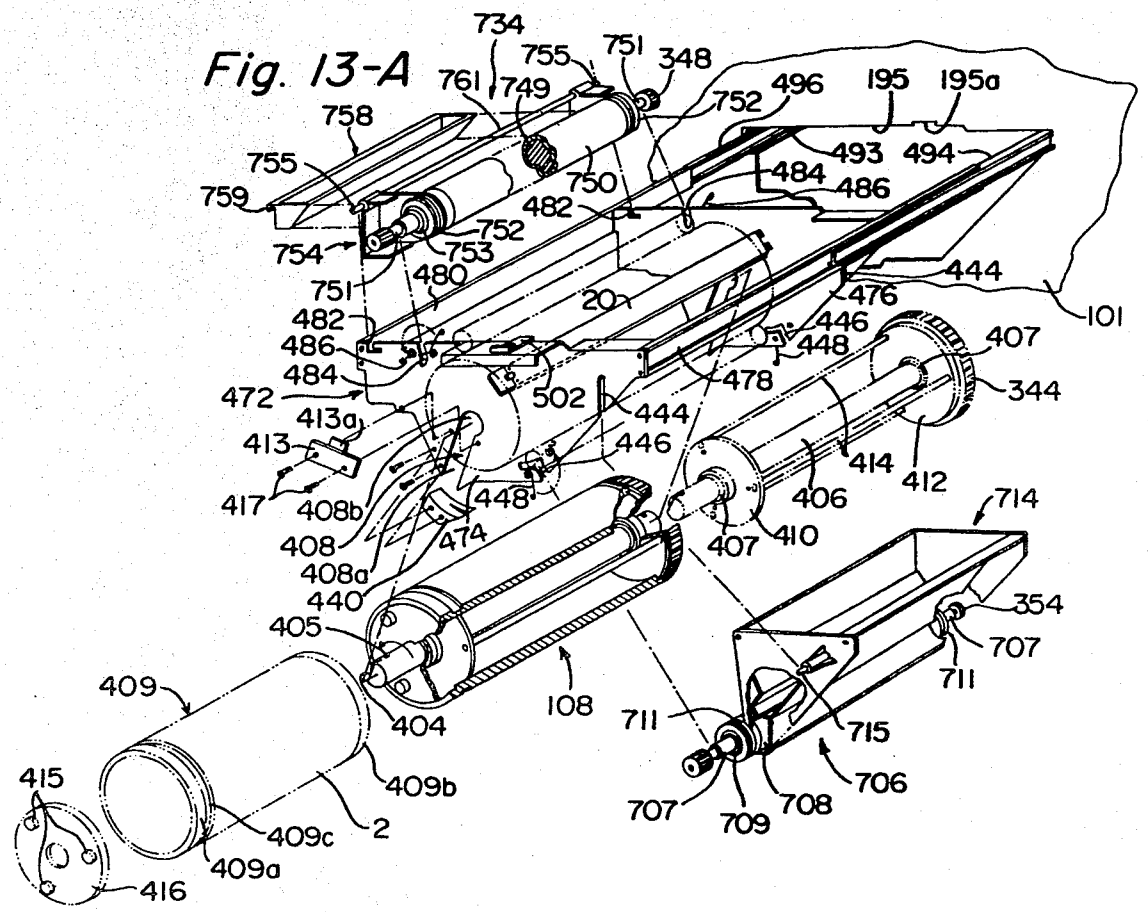
Figure 14:
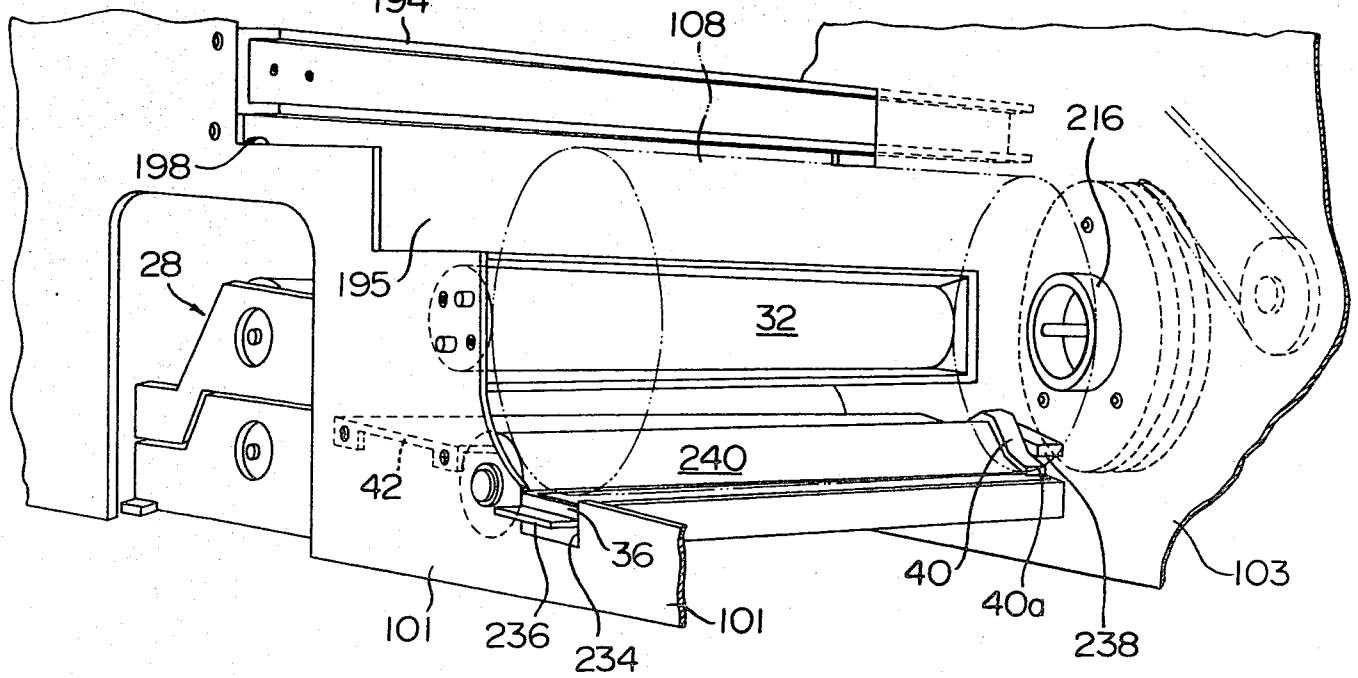
Figure 15:
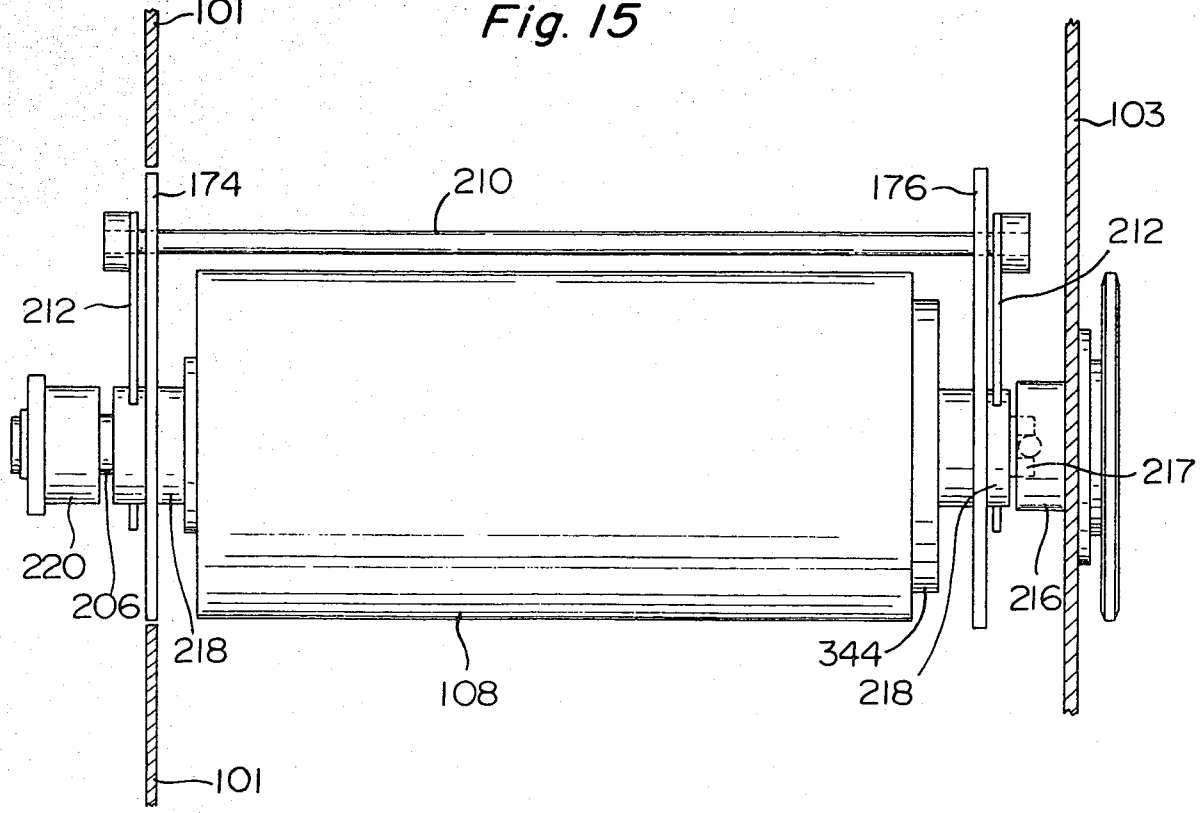
Figure 16:
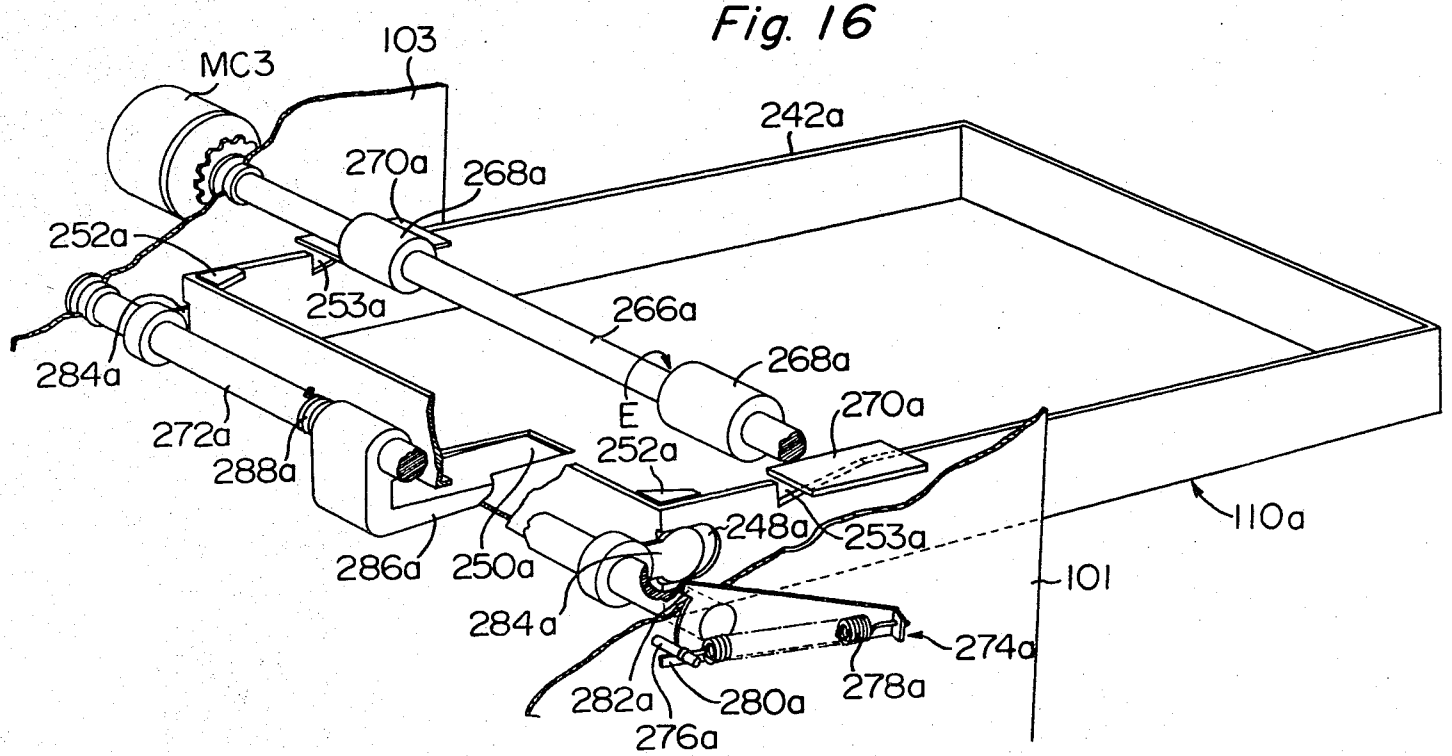
Figure 17:
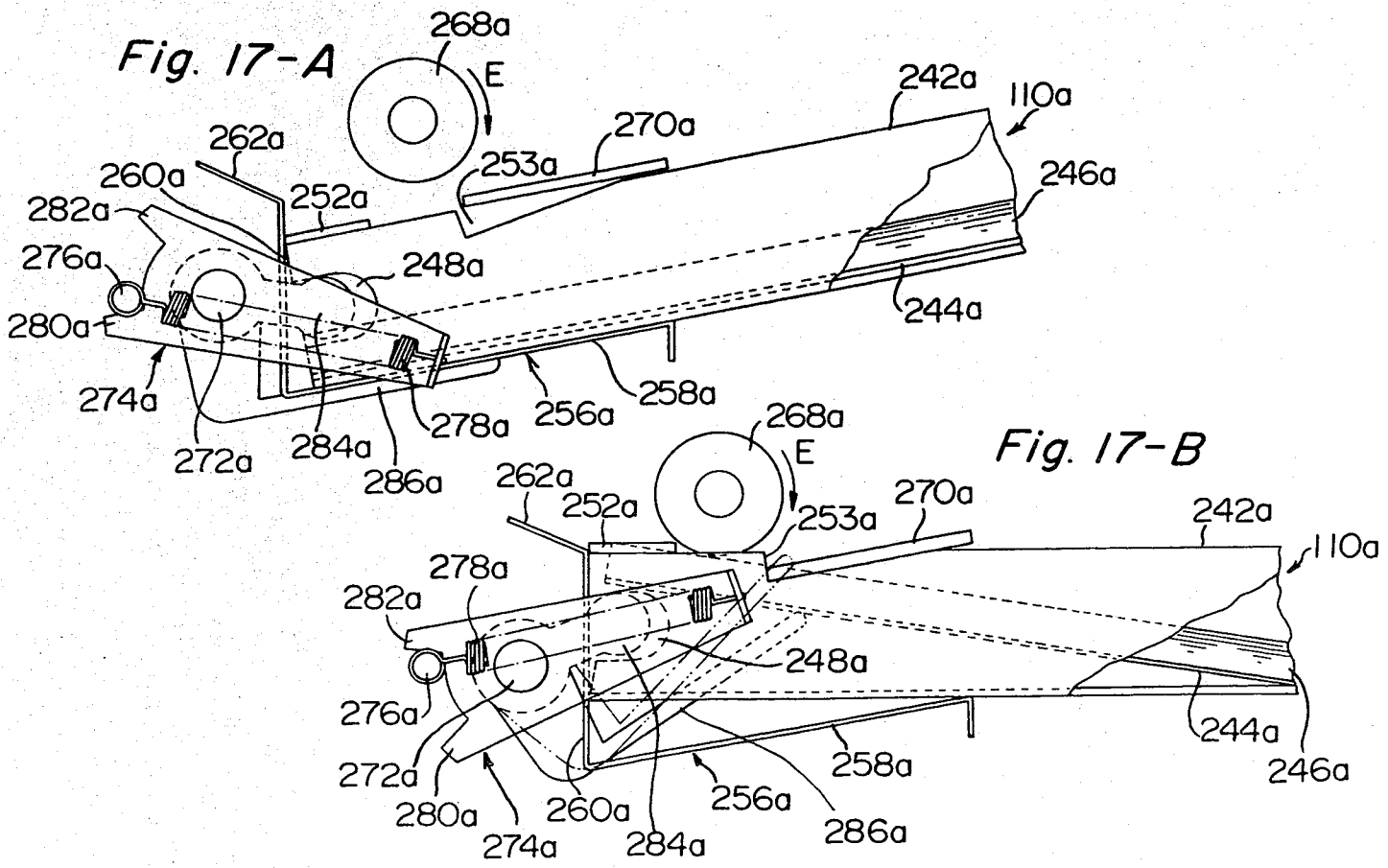
Figure 18:
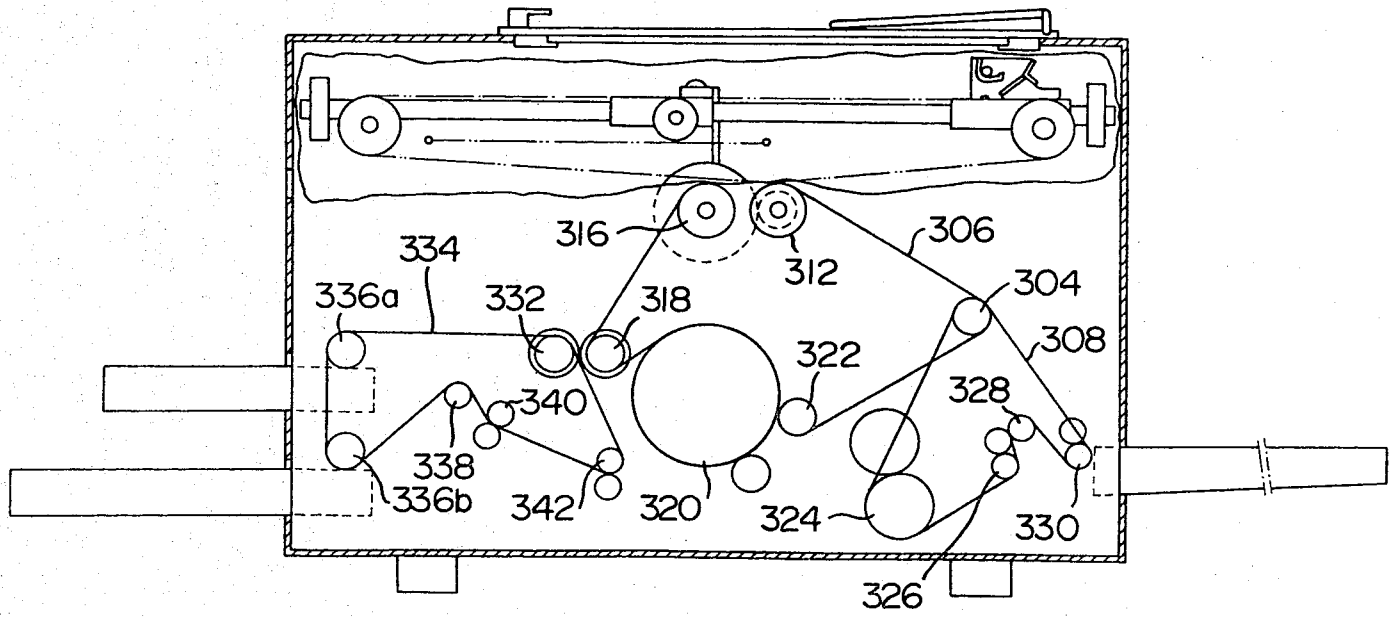
Figure 19:
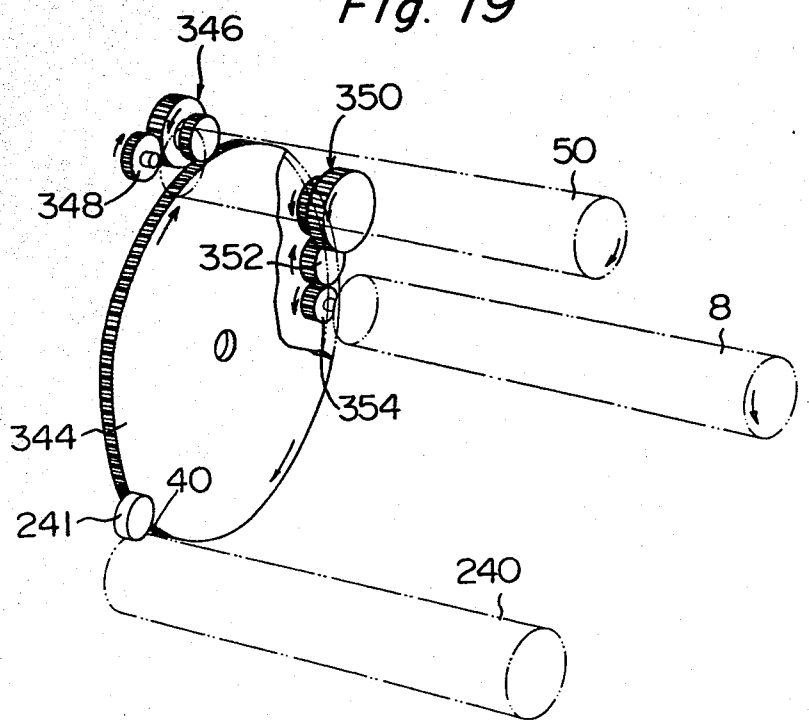
Figure 20:
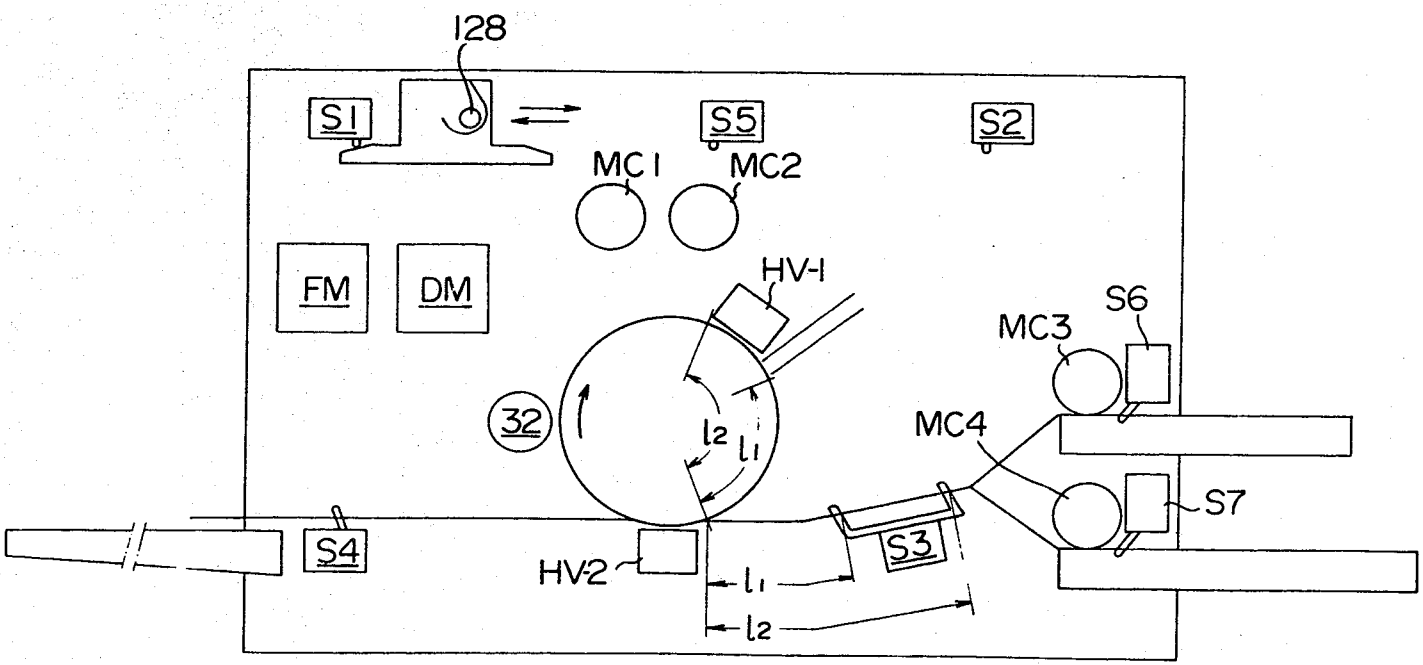
Figure 21:
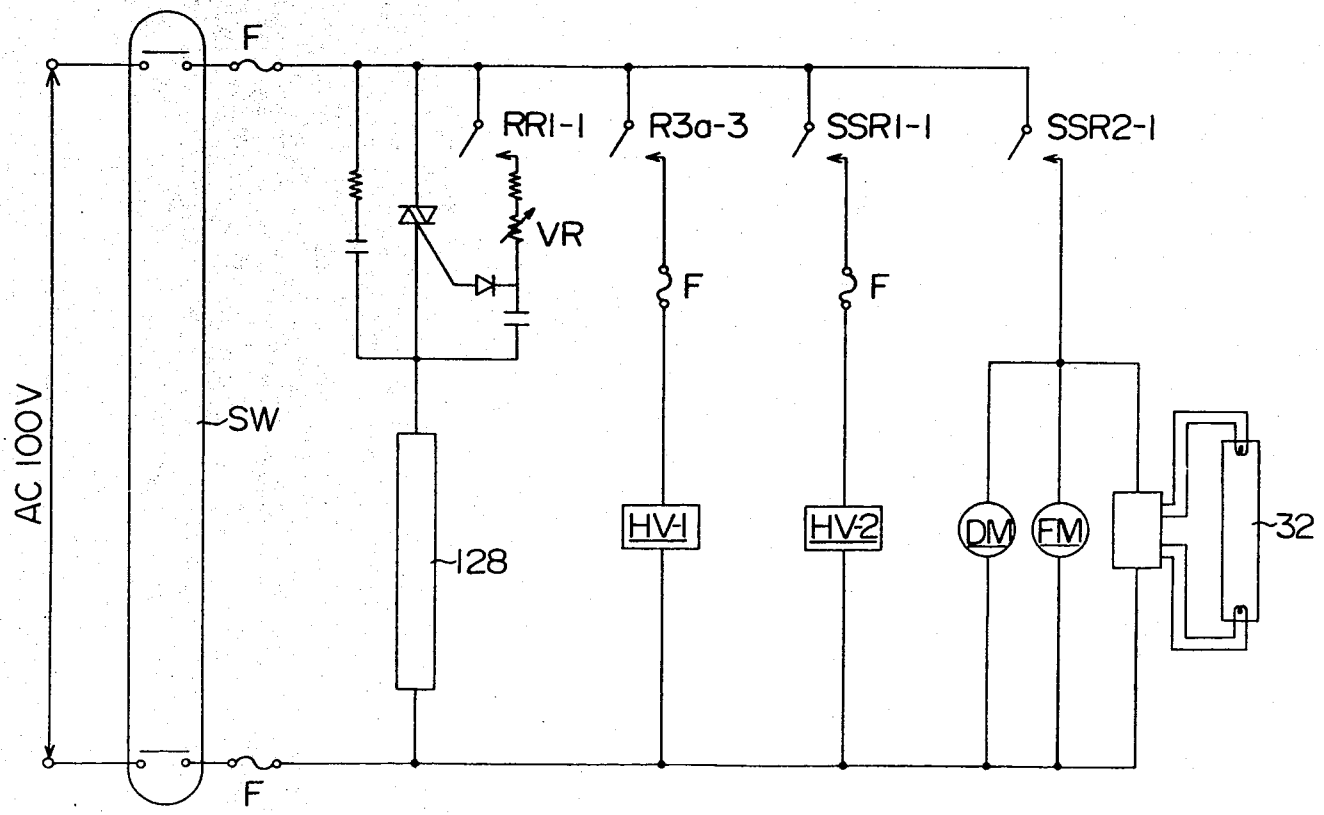
Figure 23:
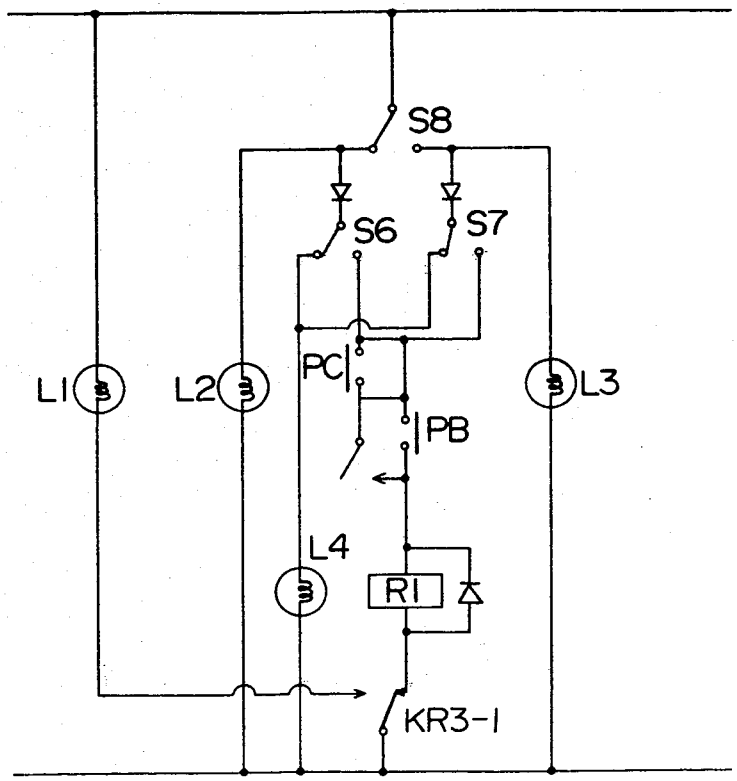
Figure 24:
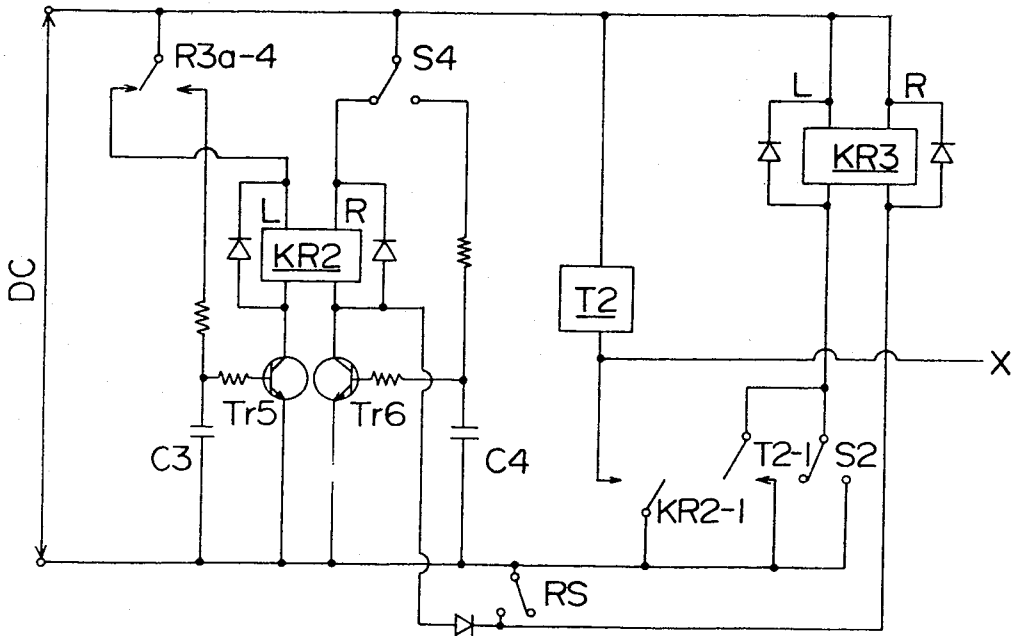
Figure 25:
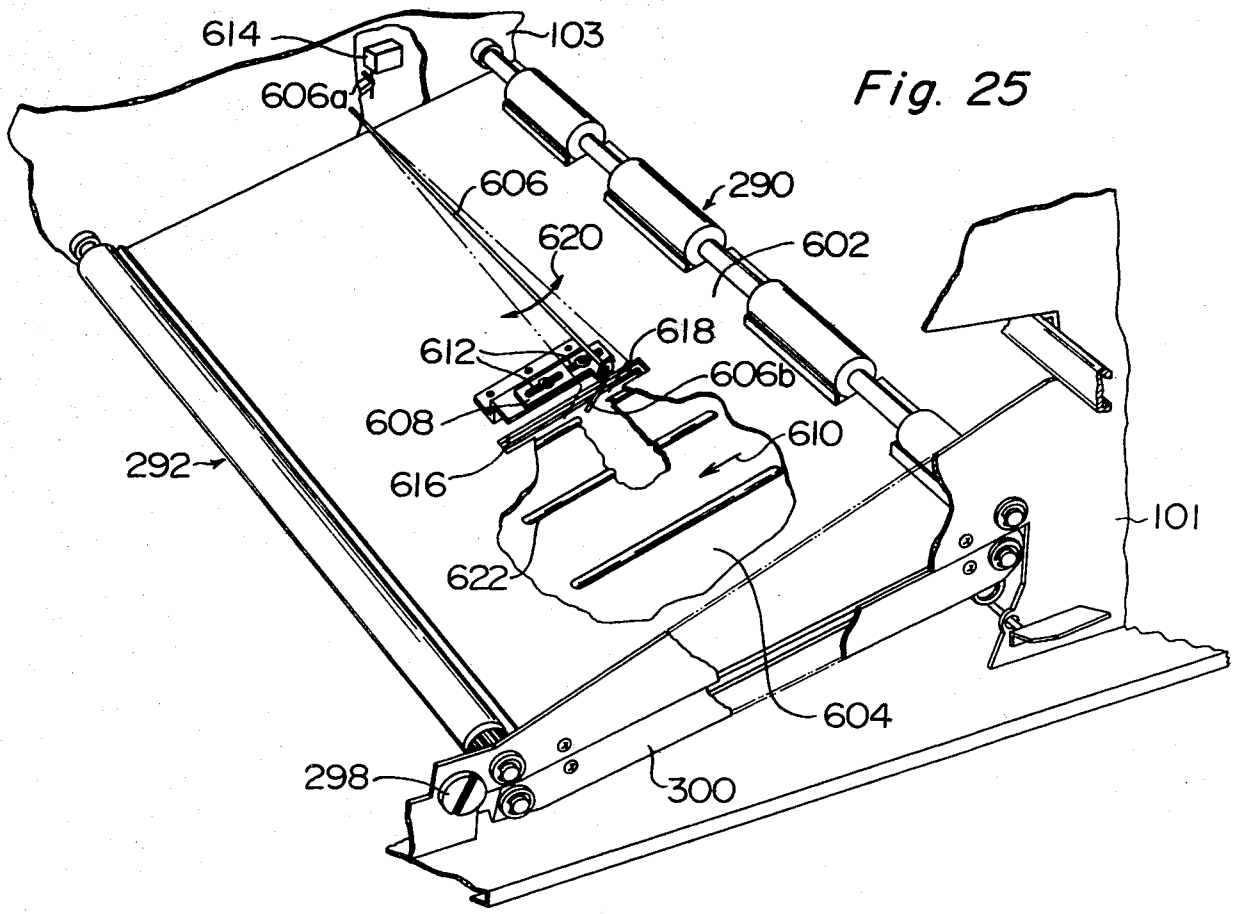

FIG. 13-A is an exploded view showing a modified example of a support and elements mounted on it;

FIG. 14 is a partial perspective view of that part of the electrostatic copying apparatus shown in FIG. 8 on which the support is mounted;

FIG. 15 is a side elevation of that part of the apparatus on which a rotary drum is mounted;

FIG. 16 is a partial perspective view of a paper feed section;

FIG. 17-A and FIG. 17-B are side elevations, partly broken away, of the paper feed section shown in FIG. 16;

FIG. 18 is a simplified view showing a drive system;

FIG. 19 is a simplified partial perspective view for illustrating the drive system;

FIG. 20 is a diagrammatic view showing electrical elements of the electrostatic copying apparatus shown in FIG. 8;

FIGS. 21 to 24 are circuit diagrams showing the electrical elements of the electrostatic copying apparatus shown in FIG. 8; and FIG. 25 is a partial perspective view showing a mechanical sensing element which may be provided to register the forward end of an original optically projected on the surface of the rotary drum with the forward end of a receptor sheet.

DETAILED DESCRIPTION OF PREFERRED EMBODIMENTS

The present invention is described in detail with reference to the accompanying drawings.

ELECTROSTATIC COPYING METHOD

Electrostatic copying processes for forming a copied image corresponding to an original image, as is well known, include a xerographic process, an electro-fax process, or a TESI process including an electrostatic latent image transferring step. All of these processes commonly include a step of forming an electrostatic latent image corresponding to an original image on a photosensitive member having a photoconductive layer, and a developing step for rendering the electrostatic latent image visible.

DEVELOPING STEP

The developing step for rendering the electrostatic latent image visible can be performed by various known developing methods. In recent years, a method involving the application of a fine powdery developer (toner) to the electrostatic latent image to be developed has been preferred.

One typical known method within this category comprises magnetically holding a fine powdery developer on the surface of a developer-holding member in the form of a hollow cylindrical sleeve or an endless belt by means of a magnet disposed within the developer-holding member, and then contacting the surface of the developer-holding member with the surface of an image-bearing member having an electrostatic latent image formed thereon (i.e., a photosensitive member or a receptor member to the surface of which the electrostatic latent image has been transferred) through the developer, thereby to apply the developer to the electrostatic latent image.

It was first suggested with regard to this known method to move the surface of the developer-holding member and the surface of the latent image-bearing member in opposite directions to each other, thereby successively contacting the two surfaces with each other. In the method according to the suggestion, however, the density of the image is low because of a fairly great slippage between the two surfaces (the difference in moving speed), and the image obtained is unsatisfactory because of a poor resolving power and a poor reproducibility of a halftone.

In an attempt to overcome this disadvantage, a "rolling contact method" was suggested which comprises moving the surface of the developer-holding member and the surface of the electrostatic latent image-bearing member in the same direction at the same speed, thereby contacting the two surfaces successively without substantial slippage (for example, U.S. patent application Ser. No. 599,953, filed on July 29, 1975, now U.S. Pat. No. 4,081,571, or British Pat. No. 1,493,280). This rolling contact method can produce an image which has a suitable image density, and has a high resolving power, and a good reproducibility of a halftone. If a monocomponent developer (so-called carrierless developer) composed of one kind of fine magnetic powder is used in this rolling contact method, the developer adheres to the surface of the latent image-bearing member too faithfully according to the potential on the surface. This causes the following disadvantages that must be overcome.

(i) The developer adheres thinly to an area which is spaced from the image area by some distance to form a so-called ghost image or fringed image.

(ii) The developer adheres thinly to the background area of the image to cause background fogging.

The ghost image formation and the background fogging are described in detail below with references to FIGS. 1-*a* and 1-*c*. An electrostatic latent image formed on the surface of electrostatic latent image-bearing member 2 has at its image area I a charge and a potential of a specific polarity (for example, positive), and because of the edge effect of the charge on the image area, a potential of an opposite polarity (for example, negative) in the area surrounding the image area. Accordingly, the potential pattern of the electrostatic image shown in FIG. 1-*a* is known to be as shown in FIG. 1-*b*. If the developer composed of a single fine magnetic powder is caused to approach the electrostatic latent image, the charge of the electrostatic latent image induces a charge of an opposite polarity in the developer, and therefore, the development of the latent image proceeds due to Coulomb's attractive force acting between the two charges. Since the developer is magnetically held on the surface of the developer-holding member, the developer, upon contact with the electrostatic latent image, adheres to that part of the latent image which has a potential above a certain value ($\pm$y V) that begins to exert an attractive force larger than the magnetic holding force of the developer-holding member on the developer, irrespective of the polarity of the potential on that part. Thus, when the surface of the electrostatic latent image-bearing member is contacted successively with the developer from right to left in FIG. 1-*a* (in the direction shown by arrow A in FIG. 1-*a*), the developer adheres to the portion of image area I, and thinly to part G which is upstream of the image area by distance x. Consequently, as shown in FIG. 1-*c*, a ghost image is formed at part G upstream of image area I. A potential above the certain value ($\pm$y V) exists on part G', spaced downstream of the image area I by distance x from where image area I ends. When the development proceeds and the potential of the latent image in image area I decreases as a result of the adhesion of the developer to image area I, the potential on part G' decreases to below $\pm$y V and therefore, substantially no ghost image forms on part G' downstream of the image area I.

In an ordinary electrostatic copying process in which an electrostatic latent image formed on a photosensitive member is directly developed, the photosensitive member is fatigued as a result of forming an electrostatic latent image in the previous cycle, and it is extremely difficult, if not impossible, to remove the fatigue completely before the beginning of the new cycle. Accordingly, the photosensitive member (i.e., the electrostatic latent image-bearing member) has some residual potential caused by the fatigue in the previous cycle in addition to the potential of the electrostatic latent image to be developed. Generally, the residual potential tends to increase gradually as a result of repeatedly using the photosensitive member with only a short interval between cycles. In the case of using an ordinary two-component developer, the developer is biased to a specified potential of the same polarity as the residual potential and thus cancels the residual potential. In contrast, in the rolling contact method, the developer adheres to the surface of the electrostatic latent image-bearing member too faithfully according to the surface potential of the image-bearing member, and in particular, a mono-component developer is attracted by a potential of either of the positive and negative polarities. Hence, if a bias voltage is applied, the adhesion of the developer is increased. Mainly for the above resson, the developer adheres also to an area having the residual potential, and the background fogging of the non-image area gradually increases as the number of copying operations increases.

The present inventors have now found that if the surface of the developer-holding member and the surface of the electrostatic latent image-bearing member are contacted with each other successively by being moved in the same direction at somewhat different speeds in a developing station where the surface of the developer-holding member is contacted with the image-bearing member through the developer, the developer which adheres weakly to the surface of the image-bearing member and causes ghost image formation and background fogging can be wiped off by exerting a mechanical brushing action on the developer held magnetically to the surface of the developer-holding member without reducing the density and resolving power of the image and the reproducibility of a halftone; and that consequently, the desired image free from ghost image formation and background fogging can be obtained.

Specifically, the present inventors have now found that in an electrostatic latent image developing process which comprises magnetically holding a fine powdery developer on the surface of a developer-holding member by means of a magnet disposed within the developer-holding member, then contacting the surface of the developer-holding member with the surface of an electrostatic latent image-bearing member through the developer, and thus applying the developer to the electrostatic latent image to develop it, an image having a high image density, a high resolving power and a superior reproducibility of a halftone and which is free from ghost image formation and background fogging can be obtained in a developing zone by moving the surface of the developer-holding member and the surface of the electrostatic latent image-bearing member which are in contact with each other in the same direction at such speeds that a speed difference of about 20 m/minute $\geqq |V_1-V_2|>0$ m/minute is provided between the moving speed $V_1$ of the surface of the developer-holding member and the moving speed $V_2$ of the surface of the electrostatic latent image-bearing member.

The speed difference differs somewhat according, for example, to the potential of the electrostatic latent image to be developed and the characteristics of the developer. It is generally about 20 m/minute $\geqq |V_1-V_2| \geqq$ about 1.0 m/minute, preferably about 20 m/minute $\geqq |V_1-V_2| \geqq$ about 3.5 m/minute. Particularly, $V_1-V_2$ is preferably a positive value.

This new finding is described in more detail with reference to FIG. 2. Electrostatic latent image-bearing member 2 having an electrostatic latent image formed on its surface, which is, for example, a rotary drum having a photoconductive layer of selenium or cadmium sulfide, is rotated in the direction shown by arrow B (clockwise direction in FIG. 2). In developing section 4, the electrostatic latent image formed on the surface is developed by a developing device generally shown at 6. The electrostatic latent image to be developed is formed on the surface of the latent image-bearing member 2 upstream of developing station 4 by any method known to those skilled in the art.

Developing device 6 includes developer-holding member 8 to be rotated, magnet 10 disposed within the member 8 and developer supplier 14 for supplying developer 12 to the surface of developer-holding member 8. Developer-holding member 8 may be any desired material which can magnetically hold the developer supplied from supplier 14 to the surface of the developer-holding member by the action of magnet 10 and which can be contacted with the surface of electrostatic latent image-bearing member 2 through the developer at developing station 4. For example, it may be an endless belt. A suitable developer-holding member is made of a hollow cylindrical sleeve and can be rotated in the direction of arrow C in FIG. 2 (in the counterclockwise direction in FIG. 2). Furthermore, as described in U.S. patent application Ser. No. 656,195, filed Feb. 9, 1976, when the developer used is a mono-component developer composed of a conductive or semiconductive fine magnetic powder (the developer will be described in detail hereinbelow), a developer-holding member composed of a main body of a nonmagnetic metallic material and an insulating coating formed on the surface of the main body is used suitably. Preferred insulating coatings are, for example, organic insulating coatings such as polystyrene or polyethylene terephthalate, inorganic insulating coatings such as aluminum oxide, or composites of these, which have a resistance of at least $10^3$ ohms/cm$^2$, especially at least $10^5$ ohms/cm$^2$.

Magnet 10 to be disposed within developer-holding member 8 may be of any type which is capable of magnetically holding the developer onto the surface of developer-holding member 8. When developer-holding member 8 is a hollow cylindrical sleeve as shown in the drawings, the magnet is preferably a stationary roll-like permanent magnet having a plurality (for example, 8) of magnetic poles which are located on its periphery and alternately have opposite polarities. Preferably, as shown in FIG. 2, such a stationary roll-like permanent magnet is generally fixed within the developer-holding member such that one of the magnetic poles is positioned upstream in the rotating direction of the developer-holding member by angle $\alpha$ with respect to position P at which the surface of electrostatic latent image-bearing member 2 approaches the surface of developer-holding member 8 most closely. If, however, developer-holding member 8 is rotated at a fairly high speed, it is sometimes preferred to position one of the magnetic poles of the permanent magnet at position P at which the surface of developer-holding member 8 approaches the surface of the electrostatic latent image-bearing member most closely. When developer-holding member 8 is rotated at a fairly high speed, the area of the developing station (the contact zone between the developer and the surface of image-bearing member 2) must be increased by bringing the surface of image-bearing member 2 closer to the surface of developer-holding member 8 to maintain the developing time (the time during which the surface of the electrostatic latent image-bearing member is in contact with the developer). If one of the magnetic poles is positioned at a point somewhat farther upstream of position P in this case, the surface of electrostatic latent image-bearing member 2 contacts the developer even at an intermediate point between magnetic poles, and development occurs also at this point.

Figure 3:
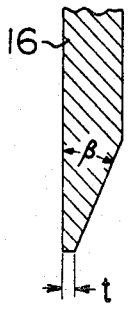
FIG. 3 is an enlarged view of a part of a brush length adjusting member used in the developing apparatus shown in FIG. 2.

The developing device 6 further includes a brush length adjusting means such as a doctor blade for controlling the thickness of the developer layer which has been supplied to the surface of developer-holding member 8 from developer supplier 14 and held there magnetically. The brush length adjusting means can be made up of, for example, member 16 which is adjustably secured to side wall 14*a* of supplier 14 that is positioned downstream in the rotating direction of developer-holding member 8. Member 16, as is clearly shown in FIG. 3, tapers toward its free end which is positioned near the surface of developer-holding member 8 at a point at which one of the magnetic poles of magnet 10 is situated in its vicinity. Preferably, the thickness of the free end is more than 0 mm and up to 1.5 mm. The angle $\beta$ defined by the two side surfaces of the free end is not more than 15°, and preferably not more than 10°.

Preferably, member 16 constituting the brush length adjusting means is disposed near the surface of developer-holding member 8 somewhat upstream of one of the magnetic poles of magnet 10 in the moving direction of the surface of developer-holding member 8. According to this construction, because of the form of the line of magnetic force generated by magnet 10, the developer within developer supplier 14 is not urged against member 16 and does not solidify there. Accordingly, a layer of the developer having a good surface condition is formed on the surface of developer-holding member 8, and the toner image developed increases in quality. It is also preferred that the tip of side wall 14*b* which forms one edge of the developer outlet of developer supplier 14 and is positioned upstream in the rotating direction of developer-holding member 8 should be disposed somewhat upstream of one of the magnetic poles of magnet 10 in the moving direction of the surface of developer holding member 8. According to this embodiment, the developer is not carried to the outside tip portion of side wall 14*b* of the developer supplier because of the form of the line of magnetic force generated by magnet 10.

Distance $d_1$ between the free end of member 16 and the surface of developer-holding member 8, as will be described hereinbelow, is closely related to distance $d_2$ between the surface of developer-holding member 8 and electrostatic latent image-bearing member 2 at position P at which these surfaces approach each other most closely. Generally, distance $d_1$ is $0.15\ mm \leqq d_1 \leqq 0.5\ mm$, especially $0.2\ mm \leqq d_1 \leqq 0.45\ mm$. If distance $d_1$ is too small, a sufficient amount of the developer cannot be supplied to the developing station 4. Conversely, if distance $d_1$ is too large, the layer of the developer held on the surface of developer-holding member 8 becomes thick, and the developer which is situated at the outermost position is held by a weak holding force. Consequently, scattering of the developer occurs at developing station 4, and the image developed is fogged. On the other hand, distance $d_2$ between the surface of developer-holding member 8 and the surface of electrostatic latent image-bearing member 2 at position P at which they approach each other most closely is closely related to the distance $d_1$ described above. Generally, the distance $d_2$ is $0.5\ mm \geqq d_2 \geqq d_1$, preferably $0.55\ mm \geqq d_2 \geqq d_1$.

Figure 4:
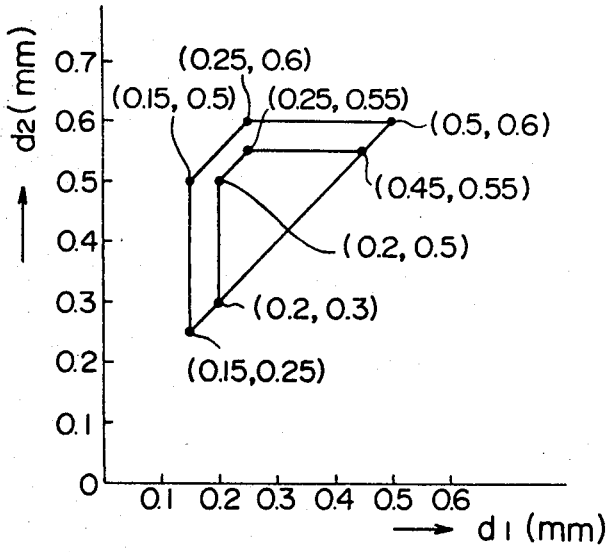
FIG. 4 is a diagram showing suitable regions of distances $d_1$ and $d_2$.

According to the information which the present inventors have obtained through research and experimental work, the distances $d_1$ and $d_2$ are preferably within the area defined by a line connecting the four points (0.15, 0.25), (0.5, 0.6), (0.25, 0.6) and (0.15, 0.5) in the graph of FIG. 4 in which $d_1$ (mm) is on the abscissa and $d_2$ (mm) is on the ordinate, and especially preferably within the area defined by a line connecting the four points (0.2, 0.3), (0.45, 0.55), (0.25, 0.55) and (0.2, 0.5).

Distance $d_3$ from the forward end of side wall 14*b* located upstream in the rotating direction of the developer-holding member, which defines one edge of the developer outlet of developer supplier 14, to the surface of developer-holding member 8 is generally $5\ mm \geqq d_3 \geqq 1\ mm$, preferably $3\ mm \geqq d_3 \geqq 2\ mm$.

Developer 12 is suitably a known mono-component developer composed of a single conductive or semiconductive fine powder with a particle diameter of 5 to 30 microns, preferably 8 to 15 microns, which is obtained by coating a fine powder of iron, cobalt or nickel, or an oxide of such a metal, or an alloy or such a metal, or a mixture of these with a resin such as an epoxy, styrene or olefin resin, or further adding a suitable coloring agent such as carbon black.

In developing device 6 described above, the surface of the developer-holding member within developing station 4 is contacted with the surface of electrostatic latent image-bearing member 2 through developer 12 retained on its surface. It is important that the two surfaces should be contacted with each other through developer 12 in the manner to be described below.

Figure 2:
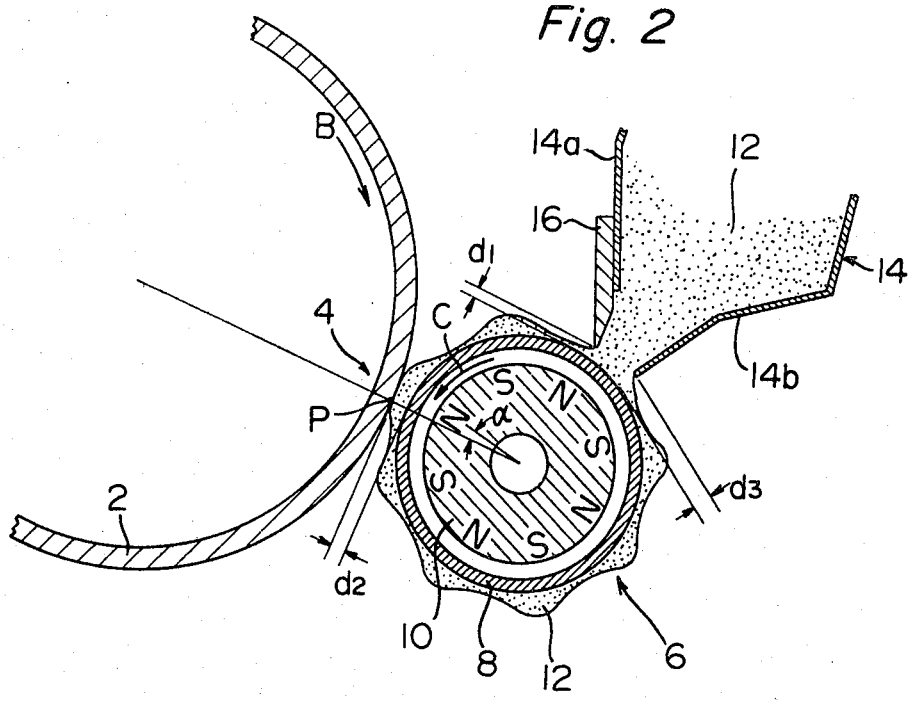
FIG. 2 is a diagrammatic sectional view of an electrostatic latent image-bearing member and a developing apparatus for illustrating the developing step in the electrostatic copying process in accordance with this invention.

Electrostatic latent image-bearing member 2 is rotated at a fixed speed in the direction of arrow B (that is, in the clockwise direction in FIG. 2), and developer-holding member 8 is rotated at a fixed speed in the direction of arrow C (that is, in the counterclockwise direction in FIG. 2). Hence, the surface of image-bearing member 2 and the surface of the developer-holding member are moved in the same direction at developing station 4 where the surface of developer-holding member 8 is contacted through the developer held on it with the surface of image-bearing member 2. These members are moved at such speeds that the moving speed $V_1$ of the surface of developer-holding member 8 differs from the moving speed $V_2$ of the surface of image-bearing member 2 as follows:

$$\text{about } 20\ m/minute \geqq |V_1 - V_2| > 0\ m/minute.$$

As described in detail with reference to FIGS. 1-*a* to 1-*c*, when a mono-component developer composed of a single type of magnetic fine powder is used in the known rolling contact method which involves moving the surface of developer-holding member 8 and the surface of image-bearing member 2 at substantially the same speeds ($V_1 - V_2 = 0$), a ghost image is formed and the background is fogged, because the developer adheres to the surface of image-bearing member 2 too faithfully according to the potential pattern of the surface. If, however, the surface of developer-holding member 8 and the surface of image-bearing member 2 are moved in the same direction at different speeds as described above, the developer which adheres thinly to the nonimage area with a weak adhering force and is likely to cause ghost image formation and background fogging is scraped off by the mechanical brushing action of the developer held magnetically on the surface of developer-holding member 8. The scraping of the developer is done without substantially reducing the density and resolving power of the image area and the reproducibility of a halftone, and the image obtained is free from ghost image formation and background fogging. If the speed difference ($V_1 - V_2$) is larger than about 20 m/minute, the mechanical brushing action of the developer magnetically held to the surface of developer-holding member becomes excessive, and the resulting image has a low density, a poor resolving power, and a poor reproducibility of a halftone. Alternatively, if the developer supplied to the developing station by the rotation of developer-holding member is insufficient, the density of the resulting image decreases.

Preferably, the speed difference ($V_1-V_2$) should be a positive value. If the speed difference ($V_1-V_2$) is a negative value (in other words, if the moving speed $V_1$ of the surface of developer-holding member 8 is less than the moving speed $V_2$ of the surface of image-bearing member 2), the amount of the developer supplied to developing station 4 by the rotation of developer-holding member 8 tends to be insufficient. Specifically, therefore, it is preferred to make the moving speed $V_1$ of the surface of developer-holding member 8 somewhat larger than the moving speed $V_2$ of the surface of the image-bearing member 2. The optimum speed difference $V_1-V_2$ differs somewhat according to the magnitude of the potential on the electrostatic latent image to be developed, the characteristics of the developer (the sensitivity of the developer to the potential), the magnetic holding power of the magnet for the developer, the moving speed (i.e., the developing speed) of the surface of image-bearing member 2, etc. In the development of an electrostatic latent image in an ordinary electrostatic copying process, the speed difference is about 20 m/minute to about 1.0 m/minute, preferably about 20 m/minute to about 3.5 m/minute.

EXAMPLE

In an apparatus of the type shown in FIG. 2, a rotary drum made by vacuum-depositing selenium on the surface of a cylindrical aluminum support having a diameter of 120 mm was used as an electrostatic latent image-bearing member. The surface of the rotary drum was uniformly charged by positive corona discharge. An original image was projected on the drum surface charged to a fixed positive potential (Vs) to form an electrostatic latent image.

A toner composed of a mono-component magnetic powder was supplied from a developer supplier to the surface of a developer-holding member made of a non-magnetic cylindrical sleeve having a magnet disposed inside, thereby to form a layer of the toner on the surface of the sleeve. The strength of the magnetic force on the surface of the sleeve was about 1,000 Gauss. The particle diameter of the toner was adjusted to 5 to 30 $\mu$ to obtain a good quality image and prevent the scattering of the toner particles at the time of transfer. The cylindrical sleeve was rotated at a suitable peripheral speed to convey the toner magnetically attracted to the surface of the sleeve to a developing position.

Thus, the toner was applied to the electrostatic latent image to form a toner image. The toner image by development was then transferred to a receptor sheet and fixed on it under pressure.

The residual charge on the rotary drum after the transferring operation was removed by the irradiation of light, and the residual toner was removed by the developing device itself or by a suitable cleaning device equivalent to the developing device.

In the formation of the electrostatic latent image, the surface of the rotary drum was charged so that its surface potential Vs would become about 700 V at the time of development. Then, a light image and a dark image of the reflecting light from an original which had been irradiated with light (adjusted to about 450 W) from a halogen lamp with a rating of 700 W (the length of the light emitting portion was about 280 mm) were projected on the surface of the rotary drum using two reflecting mirrors and an in-mirror lens. The reflecting ratio of the reflecting mirrors was more than about 95%, and the lens had an F value of 5.3 and a focal length of 235 mm.

The cylindrical sleeve used in the development was a hollow cylindrical body of aluminum having a diameter of 32.4 mm, and an aluminum oxide coating obtained by anodization at a low temperature was formed on the surface of the sleeve. The hollow cylindrical body was grounded during use. The shape of the developer supplier, the brush length adjusting member and other parts were as illustrated in FIG. 2. Various factors affecting the quality of the copies obtained were then evaluated.

[A] Distance ($d_1$) between the surface of the cylindrical sleeve and the end of the brush length adjusting member, and distance ($d_2$) between these surfaces at a point where they come closest to each other:

Experiments were performed under the aforesaid experimental conditions while varying $d_1$ and $d_2$, and the results shown in Table 1 were obtained.

TABLE 1

| | $d_1$ mm | | | | | | | | | | | | |
|---|---|---|---|---|---|---|---|---|---|---|---|---|---|
| $d_2$ mm | 0.1 | 0.15 | 0.2 | 0.25 | 0.3 | 0.35 | 0.4 | 0.45 | 0.5 | 0.55 | 0.6 | 0.65 | 0.7 |
| 0.1 | | | | | | | | | | | | | |
| 0.15 | X | | | | | | | | | | | | |
| 0.2 | X | X | | | | | | | | | | | |
| 0.25 | X | Δ | Δ | | | | | | | | | | |
| 0.3 | Δ | ○ | ○ | Δ | | | | | | | | | |
| 0.35 | Δ | ○ | ○ | ○ | Δ | | | | | | | | |
| 0.4 | Δ | ○ | ○ | ○ | ○ | Δ | | | | | | | |
| 0.45 | Δ | ○ | ○ | ○ | ○ | ○ | Δ | | | | | | |
| 0.5 | Δ | ○ | ○ | ○ | ○ | ○ | ○ | Δ | | | | | |
| 0.55 | Δ | Δ | ○ | ○ | ○ | ○ | ○ | ○ | Δ | | | | |
| 0.6 | X | Δ | Δ | Δ | Δ | Δ | Δ | Δ | Δ | Δ | | | |
| 0.65 | X | X | Δ | Δ | Δ | Δ | Δ | Δ | Δ | Δ | Δ | | |
| 0.7 | X | X | X | X | X | Δ | Δ | Δ | Δ | X | X | X | |

X - Toner image poor (useless for practical purposes)
Δ - Toner image fair (limit of practical usefulness)
○ - Toner image good
◎ - Toner image excellent The results obtained are discussed briefly below.

When $d_2$ is shorter than $d_1+0.05$ mm, the thickness of the toner layer on the surface of the sleeve is larger than $d_2$. Accordingly, the toner is compressed and solidified in the developing zone, and the development of the electrostatic latent image becomes poor. When $d_1$ is shorter than 0.1 mm, the toner density of the toner layer on the sleeve surface is low, and the density of the toner image does not increase. Furthermore, when $d_1$ is less than 0.1 mm, accuracy of mechanical dimensions and relationships, for example in the eccentricity of the cylindrical sleeve or the rotary drum, must be rigorously maintained. When within the range of $d_1 \geqq 0.1$ mm, $d_2$ is more than $d_1+0.45$ mm, $d_2$ is far larger than $d_1$, and the toner layer does not make sufficient contact with the photosensitive surface of the drum, and no useful toner image can be obtained. When the distance $d_2$ between the surface of the rotary drum and the surface of the cylindrical sleeve exceeds 0.7 mm, good results cannot be obtained. When $d_2$ is larger than 0.7 mm, the toner layer to be held magnetically onto the surface of the sleeve must necessarily be increased in thickness. When the thickness of the toner layer increases, the magnetic force exerted on the toner particles which will contact the rotary drum is weakened. Accordingly, the electrostatic force between the electrostatic latent image and the toner increases to increase fogging. At the same time, the rotation of the sleeve causes the scattering of the toner particles to soil the copying machine. When the distance $d_1$ is maintained constant, the density of the toner layer is determined according to the flowability and particle diameter of the toner, the interpole distance of the magnetic roll, the magnetic flux intensity of the magnet, etc. Hence, the distance $d_1$ should be determined according to these conditions.

[B] Relation between moving speed $V_1$ of the surface of the cylindrical sleeve and moving speed $V_2$ of the surface of the rotary drum:

(a) In consideration of the results obtained in [A], experiments were performed while maintaining $d_1=0.25$ mm and $d_2=0.4$ mm and the peripheral speed $V_2$ of the rotary drum at 11 m/minute. The cylindrical sleeve was moved at varying peripheral speeds $V_1$ in the same direction as the rotating direction of the rotary drum and the resistivity of the toner was varied. The results obtained are shown in Table 2.

TABLE 2

| Resistivity of the toner (Ω-cm) | Difference in peripheral speed between the sleeve and the drum ($V_1$-$V_2$ m/sec.) | | | | | | | | | | | | | | |
|---|---|---|---|---|---|---|---|---|---|---|---|---|---|---|---|
| | −11 | −9.6 | −8.02 | −5.04 | −2.05 | 0 | 0.92 | 2.41 | 3.5 | 6.88 | 9.86 | 12.2 | 15.82 | 19.8 | More than 19.8 |
| $10^6$ | X | ○ | ○ | ○ | Δ | X | Δ | ○ | ○ | ○ | ○ | Δ | Δ | Δ | X |
| $10^9$ | X | Δ | Δ | ○ | Δ | X | Δ | ○ | ○ | ○ | ○ | ○ | Δ | Δ | X |
| $10^{10}$ | X | X | Δ | ○ | Δ | X | Δ | ○ | ○ | ○ | ○ | ○ | ○ | Δ | X |
| $10^{11}$ | X | X | Δ | ○ | Δ | X | Δ | ○ | ○ | ○ | ○ | ○ | ○ | Δ | X |
| $10^{12}$ | X | X | Δ | ○ | Δ | X | X | Δ | ○ | ○ | ○ | ○ | ○ | ○ | Δ |
| $10^{14}$ | X | X | X | X | X | X | X | Δ | ○ | ○ | ○ | ○ | ○ | ○ | ○ |

When the peripheral speed $V_2$ of the rotary drum is 11 m/minute, a toner image of good quality is obtained within the area of 19.8 $V_1-V_2$ 2.41, or −2.05 $V_1-V_2-916$. When $V_1$ is low, non-uniformity in image tends to occur owing to the non-uniformity of the speed. Hence, special care must be taken to minimize the non-uniformity of the speed. When $V_1$ is 0, the toner is not supplied to the developing zone, and therefore, an image cannot be obtained. When the peripheral speed $V_1$ of the cylindrical sleeve is equal to the peripheral speed $V_2$ of the rotary drum ($V_1-V_2=0$), the rotary drum and the cylindrical sleeve are brought into rolling contact with each other through the toner layer, and toner adhesion occurs very faithfully to the electrostatic latent image. However, the residual potential on the rotary drum coated with photosensitive selenium for example is high, and too faithful a development is not desirable. The resistivity of the toner shown in Table 2 is a value obtained when a DC voltage of 50 V is applied to a toner layer having a thickness of 1.5 mm. The density of the image decreases with increasing resistivity of the toner. However, the image becomes hard in tone, and increases in sharpness.

(b) The toner image obtained by forming an electrostatic latent image varies according to the maximum potential of the surface of the rotary drum (i.e., the maximum potential Vs of the electrostatic latent image formed) and the resistance (R) of the toner. To make sure of this, the relation of the toner image to the Vs and R values at $V_1-V_2=3.5$ m/minute was examined. The results are shown in Table 3.

TABLE 3

| Resistivity R of the toner (Ω-cm) | Maximum potential Vs (Volts) | | | | | | | | | | | | | |
|---|---|---|---|---|---|---|---|---|---|---|---|---|---|---|
| | 200 | 300 | 400 | 500 | 600 | 700 | 800 | 900 | 1000 | 1100 | 1200 | 1300 | 1400 | 1500 |
| $10^6$ | ○ | ○ | ○ | Δ | Δ | X | X | X | — | — | — | — | — | — |
| $10^7$ | ○ | ○ | ○ | ○ | Δ | Δ | X | X | — | — | — | — | — | — |
| $10^8$ | Δ | ○ | ○ | ○ | Δ | Δ | X | X | X | — | — | — | — | — |
| $10^9$ | Δ | ○ | ○ | ○ | ○ | Δ | Δ | Δ | Δ | X | — | — | — | — |
| $10^{10}$ | X | Δ | ○ | ○ | ○ | ○ | ○ | Δ | Δ | X | — | — | — | — |
| $10^{11}$ | X | X | Δ | ○ | ○ | ○ | ○ | Δ | Δ | X | — | — | — | — |
| $10^{12}$ | X | X | Δ | ○ | ○ | ○ | ○ | Δ | Δ | X | X | — | — | — |
| $10^{13}$ | X | X | X | Δ | Δ | ○ | ○ | Δ | Δ | X | X | X | X | — |
| $10^{14}$ | X | X | X | X | X | X | Δ | Δ | Δ | X | X | X | X | X |

When the surface potential Vs reaches 800 V, a ghost image begins to appear. When it exceeds 1000 V, the ghost image increases very much, and the resulting image is useless. When the resistivity of the toner exceeds $10^{14}$ ohms-cm, a sufficient image density cannot be obtained unless the surface potential is increased to an extreme extent. Toner particles having a low resistivity adhere to the electrostatic latent image in an increasing amount, and therefore, the fog density increases. For this reason, a good image cannot be obtained unless the surface potential is reduced. When the surface potential is less than 200 V, the density of the image decreases to an extreme extent (the reflective image density is less than 0.5), and the image obtained is not usable. Even when the surface potential is less than 200 V and the resistivity of the toner is less than $10^6$ ohms-cm, the density of the image can be increased by weakening the magnetic force of the developer-holding member. However, since the surface potential of a bright area of the image (the residual potential) is almost constant, the amount of the toner adhering to the residual potential increases, and the resulting image has an extremely high fog density.

ELECTROSTATIC COPYING PROCESS WHICH INVOLVES DEVELOPING AN ELECTROSTATIC LATENT IMAGE FORMED ON A PHOTOSENSITIVE MEMBER, AND TRANSFERRING THE DEVELOPED IMAGE TO A RECEPTOR SHEET (TheToner Image-transferring Step)

As described hereinabove, various forms of electrostatic copying processes exist for producing a copied image corresponding to the image of an original. In recent years, there has been an increasing demand for "plain paper copying (PPC)" by which a copied image is formed on a sheet of plain paper (including papers which have been slightly processed but which are substantially equivalent to plain paper).

The electrostatic copying process for producing a copied image on plain paper generally includes a step of forming an electrostatic latent image corresponding to an original image on a photosensitive member, a developing step for applying a fine powder developer (toner) to the resulting electrostatic latent image to render it visible, a step of transferring the toner image on the photosensitive member after the transferring, and a cleaning step for removing the toner remaining on the photosensitive member after the transferring.

Figure 5:
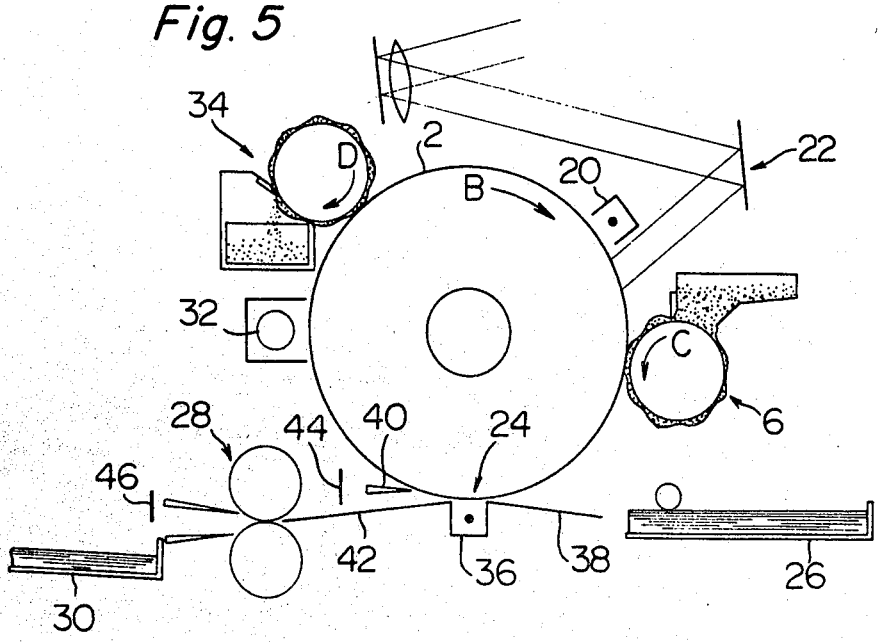
FIG. 5 is a diagrammatic view of an electrostatic copying apparatus for illustrating the electrostatic copying process in accordance with this invention.

Referring to FIG. 5, the electrostatic copying process is briefly described below. The photosensitive member (i.e., the electrostatic latent image-bearing member) 2 which is in the form of a photosensitive drum to be driven in the direction of arrow B first undergoes the action of corona discharge device 20, and a static charge is applied to the surface of photosensitive member 2 (the charging step). Then, the image of an original (not shown) is projected onto the surface of the photosensitive member 2 by an optical system 22 in an original image exposing zone located downstream of the corona discharge device in the rotating direction of photosensitive member 2 (the step of exposing an original image). Consequently, an electrostatic latent image corresponding to the original image is formed on the surface of photosensitive member 2 (the electrostatic latent image-forming step). Then, by a developing device 6 desirably of the type shown in FIG. 2, a fine powdery developer (toner) is applied to the electrostatic latent image on the surface of photosensitive member 2 to develop the latent image into a toner image (the developing step). Then, the toner image on photosensitive member 2 is transferred in transferring zone 24 to a receptor sheet fed from a receptor sheet supplying section composed, for example, of paper supply cartridge 26. The receptor sheet having the toner image transferred to its surface is sent to fixing device 28 constructed, for example, of a pair of press rollers, and the toner image is fixed to the receptor sheet under pressure, after which the sheet is discharged onto receiving tray 30 (the fixing step). In the meantime, the photosensitive member, after the toner image formed on it has been transferred to the receptor sheet, is irradiated with electrostatic eliminating lamp 32, whereby the residual charge on the photosensitive member is removed (the charge eliminating step). The toner remaining on the photosensitive member is removed (the cleaning step).

TONER IMAGE TRANSFERRING STEP

The toner image transferring step in the electrostatic copying process summarized above is conveniently carried out generally by bringing the surface of photosensitive member 2 into close contact with the surface of the receptor sheet in transferring zone 24, and applying a discharge current to the receptor sheet from the back side thereof using corona discharge device 36 for transfer.

The toner image transfer method described, however, has the defect that some distortion occurs in the toner image transferred onto the receptor sheet. The present inventors extensively studied the distortion of the toner image, and obtained the following information. In the conventional method for toner image transfer, the receptor sheet to be fed into the transfer zone first passes between shield side plates of corona discharge device 36, and is then brought into close contact with the surface of photosensitive member 2. Accordingly, before the surface of photosensitive member 2 comes into close contact with the surface of the receptor sheet, both surfaces are influenced by the discharge current of discharge device 36. As a result, the toner on the surface of photosensitive member 2 or on the surface of the receptor sheet undergoes vibration between the two surfaces and is thus scattered. Scattering of the toner, in turn, causes distortion of the toner image transferred to the receptor sheet.

On the basis of this information, the present inventors have found that the distortion of the toner image on the receptor sheet due to this scattering can be effectively prevented by bringing the surface of photosensitive member 2 into close contact with the surface of the receptor sheet as soon as, or before, the receptor sheet passes between the shield side plates of corona discharge device 36 (that is to say, before the receptor sheet enters a zone where it is influenced by the discharge current), and thereby physically preventing the vibration and scattering of the toner particles.

The close contact of the surface of photosensitive member 2 with the surface of the receptor sheet before the passing of the receptor sheet between the shield side plates of corona discharge device 36 can be achieved, for example, by positioning the ends of the shield side plates (especially the one which is more upstream in the moving direction of the receptor sheet) of corona discharge device 35 in proximity to the surface of photosensitive member 2, and properly disposing, with respect to corona discharge device 36, that part of the receptor sheet conveying path which is situated upstream of corona discharge device 36 in the moving direction of the receptor sheet (the path is formed by receptor sheet guide plate 38, etc. although this is not shown in detail in the drawings), as shown in FIG. 5.

FIXING STEP

The receptor sheet closely contacting the surface of photosensitive member 2 in the transfer step is separated from the surface of photosensitive member 2 by such a means as peeling member 40 at a point downstream of transfer station 24. It is then conveyed to receiving tray 30 through fixing device 28.

In the step of conveying the receptor sheet from transfer station 24 to receiving tray 30, the receptor sheet collects static charge at the time of transferring of fixing the toner image by fixing device 28. The electrostatic charge may cause the receptor sheet to turn upward from the surface of guide plate 42 in the transfer path from transfer station 24 to fixing device 28, and thus paper jamming occurs. Or the electrostatic charge causes the receptor sheet to turn upward at the time of discharge into receiving tray 30, and the receptor sheet cannot be properly discharged onto receiving tray 30.

Figure 6:
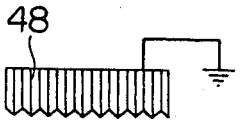
FIG. 6 is a simplified view of an electrostatic charge eliminator.

Electrostatic eleminators 44 and 46 may conveniently be "sparkless electrostatic eliminators" which are obtained by processing an electrically conductive cloth or resin plate, a cloth having fine electrically conductive fibers or fine metal wires interwoven therein or a film having a fine conductive powder dispersed in the resin and in a saw tooth form such as shown at 48 in FIG. 6, so as to permit a corona discharge between the sharp edges of the saw teeth and a charged body.

CLEANING STEP

After the transferring of the toner image formed on the surface of photosensitive member 2 to the surface of the receptor sheet at transfer station 24, the toner remaining on the surface of photosensitive member 2 can be removed by various methods, for example, by lightly rubbing the surface of photosensitive drum 2 with a rotary fur brush. Preferably, cleaning can be performed by contacting a hollow cylindrical or endless belt-like, developer-holding member having a toner magnetically held to its surface by the action of a stationary permanent magnet disposed in its inside, with the surface of photosensitive member 2 through the developer layer on the developer-holding member while providing the largest possible difference in speed beween them (therefore, it is preferred to move the surface of the developer-holding member in a direction opposite to the moving direction of the surface of photosensitive member 2).

Figure 7:
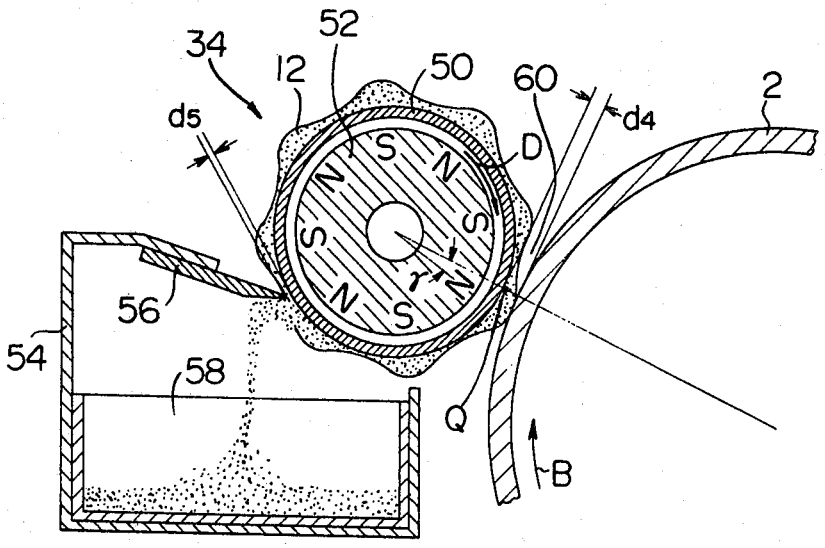
FIG. 7 is a diagrammatic sectional view of an electrostatic latent image-bearing member and a cleaning device for illustrating a cleaning step in the electrostatic copying process in accordance with this invention.

Referring to FIG. 7, cleaning device 34 which performs the cleaning method described above includes developer-holding member 50 preferably of a hollow cylindrical form, and stationary permanent magnet 52 disposed within it. Preferably, developer-holding member 50 and magnet 52 are equivalent to developer-holding member 8 and magnet 10 used in developing device 6 described hereinabove with reference to FIG. 2. The developer-holding member 50 magnetically holding toner 12 (the same as the toner used for development) on its surface by the action of magnet 52 is rotated in the direction of arrow D (in clockwise direction in FIG. 7) so that its surface moves in a direction opposite to the moving direction of the surface of photosensitive member 2. Thus, the surface of developer-holding member 50 is continuously contacted with the surface of photosensitive member 2 through developer layer 12. Brush length-adjusting member 56 secured to frame member 54 is provided at a position downstream by a fixed distance from position Q (at which the surface of developer-holding member 50 is closest to the surface of photosensitive member 2) in the rotating direction of member 50. The end of brush length-adjusting member 56 is close to the surface of developer-holding member 50, and serves to remove the excess of the developer from developer-holding member 50 and adjust the length of the developer brush on developer-holding member 50 to the desired value. Frame member 54 has receptacle 58 removably secured to it. Receptacle 58 is positioned beneath brush length-adjusting member 56 and is adapted to receive the developer which has been removed from the surface of developer-holding member 50 by the action of brush length-adjusting member 56 and fallen downward.

In cleaning device 34, the surface of developer-holding member 50 is moved in a direction opposite to the moving direction of the surface of photosensitive member 2. Hence, developer layer 12 magnetically held on the surface of developer-holding member 50 slides over the surface of photosensitive member 2 at a fairly high relative speed. The mechanical brushing action of the developer thus causes the remaining toner on the surface of photosensitive member 2 to be removed from it, and the toner is magnetically attracted to the surface of the developer-holding member. This action is more effective the larger the magnetic action of the magnet 52 and the higher the rotating speed of developer-holding member 50 (i.e., the larger the relative speed of the surface of member 50 and member 2). The developer layer on developer-holding member 50 which has become excessive as a result of the adhesion of the developer removed from the surface of photosensitive member 2 undergoes the action of brush length-adjusting member 56. As a result, the excess of the developer (the amount of the developer which corresponds to the amount of the developer removed from the surface of photosensitive member 2) is removed from developer-holding member 50, and let fall into receptacle 58.

In the cleaning method using cleaning device 34 described above, it is important to avoid the formation of a deposit of the developer in area 60 which is upstream of position Q at which the surface of photosensitive member 2. The deposit of the developer is formed by the developer which has been carried to area 60 by developer-holding member 50. If the deposit of the developer is formed in area 60, the surface of photosensitive member 2 which has been mechanically brushed at position Q then makes contact with the deposit of the developer not sufficiently held to the surface of developer-holding member 50. As a result, the developer would again adhere to the surface of photosensitive member 2.

To avoid the formation of the deposit of the developer in area 60, it is important to dispose magnet 52 so that one of the poles of magnet 52 which is closest to position Q is positioned downstream of the rotating direction of the developer-holding member 50 by certain angle $\gamma$ which is preferably not more than 15° with respect to position Q.

It is also very important to properly adjust distance $d_4$ between the surface of developer-holding member 50 and the surface of photosensitive member 2 at position Q where the two surfaces are the closest to each other, and distance $d_5$ between the end of brush length-adjusting member 56 and the surface of developer-holding member 50. Distance $d_4$ can be set within the range of 1.2 to 0.5 mm, and distance $d_5$ within the range of 0.6 to 0.25 mm, in such a manner that the deposit of the developer will not form.

Cleaning can be performed fairly well even if the rotating direction of the developer-holding member 50 is the same as the moving direction of photosensitive member 2. In this case, the relation between $d_4$ and $d_5$ is substantially the same as that between $d_2$ and $d_1$ described hereinabove.

DECREASING OF THE AMOUNT OF THE DEVELOPER TO BE REMOVED

It is known that in the conventional electrostatic copying apparatus for performing the electrostatic copying process described hereinabove with reference to FIG. 5, the amount of the developer to be removed from the surface of photosensitive member 2 by cleaning device 34 and received by receptacle 58 is fairly large. The reason for this has been investigated. It has been consequently found that the amount of toner particles which remain on the surface of photosensitive member 2 after the transfer is relatively small and can be neglected if the toner image transferring step is carried out with a good transfer efficiency; and that the amount of toner particles which are carried to the cleaning device due to adhering to the surface of photosensitive member 2 is quite large, and a considerable portion of the developer particles removed from the surface of photosensitive member 2 into receptacle 58 by cleaning device 34 is the latter-mentioned toner.

In the conventional electrostatic copying apparatus, corona discharge device 20 for charging and the original illuminating lamp (not shown) of optical system 22 are adapted to be de-energized as soon as a electrostatic latent image is formed on the surface of photosensitive member 2 by the charging step and image-exposing step. Hence, a part of the surface of photosensitive member 2 which is positioned between the shield side plates of corona discharge device 20 upon the completion of the electrostatic latent image-forming step is already charged, and, without being exposed to the light from the lamp of optical system 22, proceeds to a position where it undergoes the action of developing device 6 by the rotation of photosensitive member 2. Hence, a fairly large amount of the developer adheres to that part of the surface of photosensitive member 2 which has been described above (the developer adheres to the entire surface to make it black). The above-mentioned part of the surface of the photosensitive member 2 does not form an image corresponding to an original image. Usually, without being contacted closely with the receptor sheet at transfer station 24, this part advances past transferring station 24, the position where it undergoes the action of electrostatic eliminating lamp 32 to a position where it undergoes the action of cleaning device 34. Accordingly, a rather large amount of the developer adhering to the above-mentioned part of the surface of photosensitive member 2 by the action of developer device 6 is carried directly to a position where it undergoes the action of cleaning device 34. This developer is removed from the surface of photosensitive member 2 by the action of cleaning device 34, and constitutes a major proportion of the developer received in receptacle 58.

The conventional electrostatic copying apparatus, therefore, has the disadvantage that a considerable amount of the developer transferred by developing device 6 is wasted, and the irradiating light from electrostatic eliminating lamp 32 is shielded by the developer adhering to the surface of photosensitive member 2 in a solid black coating and the eliminating effect of the electrostatic eliminating lamp 32 is insufficient.

This disadvantage can be overcome to a considerable extent by de-energizing only the corona discharge device 20 upon the completion of the electrostatic latent image-forming step, and de-energizing the original-projecting lamp of optical system 22 with a predetermined time lag (substantially equal to, or longer than, the time required for that part of photosensitive member 2, which is situated between the shield side plates of discharge device 20 when corona discharge device 20 is de-energized, to pass the original image projecting zone by the rotation of photosensitive member 2). By so doing, that part of photosensitive member 2, which has been charged at the time the corona discharge device 20 is de-energized, receives light from the original-illuminating lamp which is reflected by the white back surface of an original press member (not shown), the original, etc. in the original image projecting zone, and thereby a considerable amount of the electrostatic charge applied to the above-mentioned part of photosensitive member 2 is removed.

As stated above, the light from the original-illuminating lamp is projected on the surface of the photosensitive member 2 after it has been reflected by the back surface of the original press member or by the original. However, especially when the light is reflected by an original including an image area, the static charge applied to the above-mentioned part of photosensitive member 2 cannot be completely eliminated. To eliminate the electrostatic charge exactly and completely, an additional static eliminating lamp (now shown) capable of lighting the surface of photosensitive member 2 directly or through a reflecting mirror is provided between corona discharge device 20 and developing device 6, and for a time period which corresponds to the above-mentioned time lag, this additional eliminating lamp is energized upon the completion of the electrostatic latent image-forming step (that is, when corona discharge device 20 and original-illuminating lamp of optical system 22 have been de-energized). The above-mentioned problem can therefore be completely solved by this means. If the toner image transferring step is carried out with a good transferring efficiency (for example, at least 85%, especially at least 90%) in the apparatus of this construction, the amount of the developer which remains on the surface of photosensitive member 2 after transfer of the toner image is very small, and therefore, cleaning device 34 can be omitted.

ELECTROSTATIC COPYING APPARATUS

The following description concerns a preferred embodiment of the electrostatic copying apparatus in accordance with this invention for carrying out the electrostatic copying process described above with reference to FIG. 5 which comprises applying an electrostatic charge to the surface of photosensitive member 2 having a photoconductive layer by corona discharge device 20 (the charging step), then projecting the image of an original of the surface of photosensitive member 2 by an optical system (the original image exposing step), thus forming a electrostatic latent image corresponding to the original image on the surface of photosensitive member 2, then applying a fine powdery developer (toner) to the electrostatic latent image on the surface of photosensitive member 2 by developing device 6 to develop the latent image into a toner image (the electrostatic latent image developing step), transferring the resulting toner images to the surface of a receptor sheet (the toner image transferring step), and fixing the toner image on the receptor sheet (the fixing step).

GENERAL CONSTRUCTION

The general construction of the electrostatic copying apparatus is described with reference to FIGS. 8 and 9.

The electrostatic copying apparatus has a substantially rectangular parallelpipedal housing shown generally at 100. On the top surface of housing 100 are provided transparent plate 102 on which to place an original to be copied, flexible, original-holding plate 104 for covering the original placed on transparent plate 102, and control panel 106 having control switches and other components to be described.

Rotary drum 108 having photosensitive member 2 mounted on its surface is disposed at the center of the lower half portion of housing 100. Around drum 108 which is to be rotated in the direction of arrow B are arranged along the moving direction of the surface of rotary drum 108 a corona discharge device 20 for charging, developing device 6, corona discharge device 36 for transfer, electrostatic eliminating lamp 32, and cleaning device 34 in this order. Optical system 22 for projecting the image of an original placed on transparent plate 102 onto the surface of rotary drum 108 at an exposing station between corona discharge device 20 for charging and developing device 6 is disposed above rotary drum 108 and within the upper half portion of housing 100. Below the rotary drum and within the lower part of housing 100 is provided conveyor system 112 for conveying a receptor sheet from paper-supplying cassette 110*a* or 110*b* mounted on one end portion of housing 100 (on the right-hand end in FIGS. 8 and 9) to receiving tray 30 mounted on the other end portion (on the left-hand end in FIGS. 8 and 9) of housing 100 through a transfer station having corona discharge device 36 disposed thereat. Fixing device 28 composed of a pair of cooperating press rollers 114*a* and 114*b* is provided in a space in receptor sheet conveying system 112 which is between the transfer station and receiving tray 30.

The constituent elements of the apparatus are described in more detail below.

PARTITIONING OF THE HOUSING, AND A COOLING SYSTEM

Figure 11:
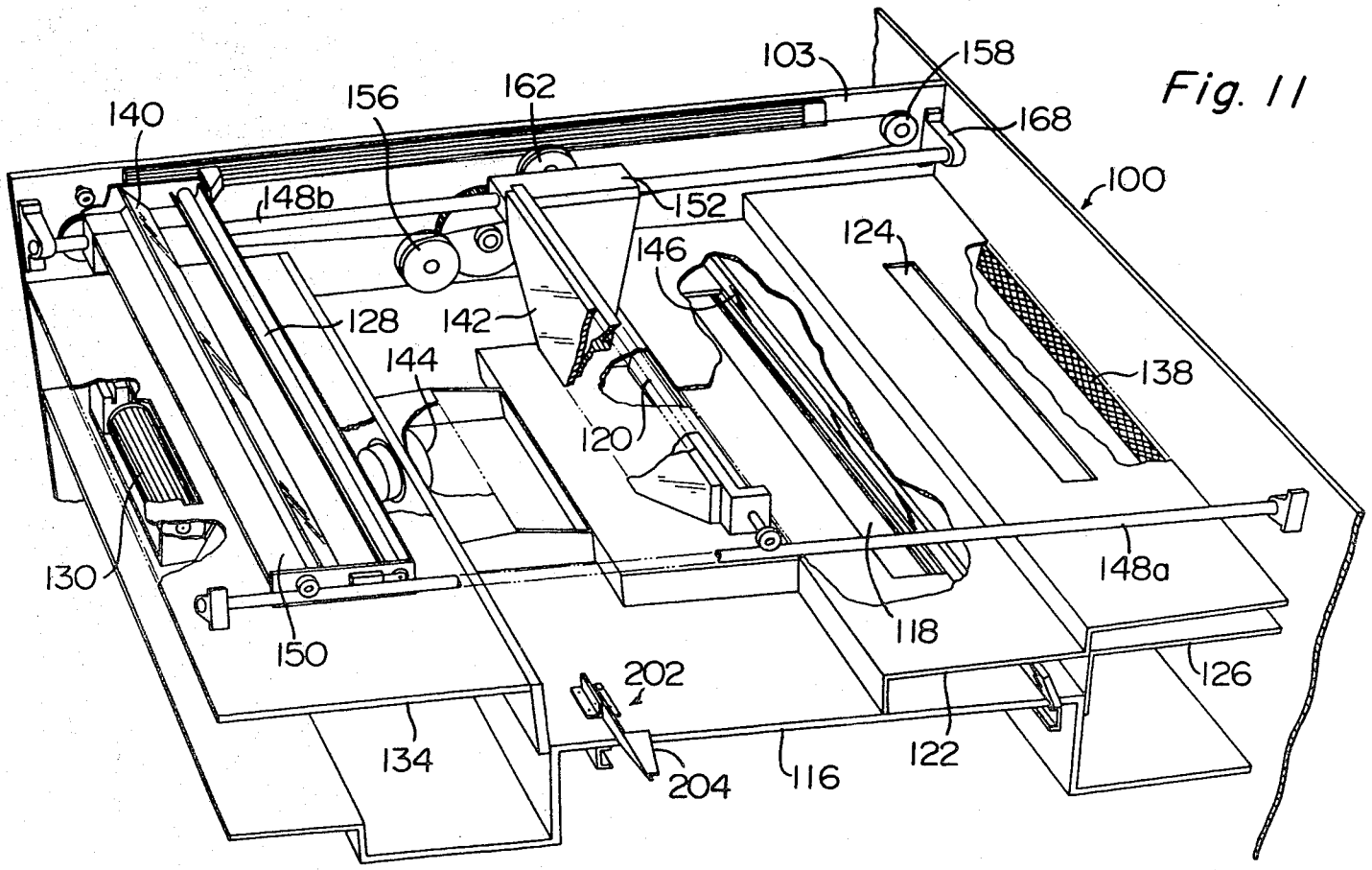
FIG. 11 is a perspective view, partly broken away, of an upper part of the electrostatic copying apparatus shown in FIG. 8.

Within housing 100 are disposed front vertical base plate 101 extending from its one end to the other side and rear vertical base plate 103 (see FIG. 11). Between two base plates 101 and 103 is fixed partitioning plate 116 which extends from one side of housing 100 to the other and partitions the space between two base plates 101 and 103 into an upper portion including optical system 22 and a lower portion including rotary drum 108, the various devices provided around rotary drum 108 and receptor sheet conveyor system 112. As will be described hereinbelow, partitioning plate 116 has opening 118 through which to pass the light to be projected onto the surface of rotary drum 108 by the optical system 23. At a position on partitioning plate 116 which is spaced from opening 118 to the left in FIG. 9 by a fixed distance, the lower end of vertical transparent plate 120 through which the above light can pass is connected. Preferably, vertical transparent plate 120 has the same thickness and is of the same material as transparent plate 102. If vertical transparent plate 120 does not have the same refractive index as transparent plate 102, the image projected on the surface of rotary drum 108 would be out of focus. The upper end of vertical transparent plate 120 is connected to a partitioning plate extending to the right end portion of housing 100. Partitioning plate 122 has opening 124 at its right-hand end portion extending substantially horizontally. Furthermore, partitioning plate 126 for blocking the communication of opening 118 in partitioning plate 116 with opening 124 is partitioning plate 122 is removably secured between partitioning plates 116 and 122.

It will be appreciated therefore that the space between front vertical base plate 101 and rear vertical base plate 103 is partitioned into an upper half and a lower half by partitioning plate 116, and the upper half and lower half portions are each sealed by the cooperation of partitioning plates 116, 122 and 126 and vertical transparent plate 120 so that they do not communicate with each other.

The upper half portion of the space between front vertical base plate 101 and rear vertical base plate 103 includes optical system 22, and suction blower 130 which consitutes a cooling system for cooling original-illuminating lamp 128 of optical system 22. As will be described hereinbelow, this lamp 128 is adapted to be reciprocated substantially horizontally within housing 100. Suction blower 130 provided near the left end of the upper half portion sucks the air through suction opening 132 formed in the left end wall of housing 100, as shown by arrows. The air sucked by suction blower 130 is discharged from openings 136 formed in partitioning plate 134, then proceeds toward the right of the upper half portion, passes through opening 124 of partitioning plate 122, further passes through discharge openings 138 formed on the right-hand end wall of housing 100, and is thus discharged from housing 100. This air flow effectively cools original-illuminating lamp 128.

Generally, original-illuminating lamp 128 of optical system 22 attains a very high temperature durings it operation. It is necessary therefore to suck the air from outside the housing 100, direct the air flow to original-illuminating lamp 128 to cool it, and then discharge the air flow out of housing 100. On the other hand, photosensitive member 2 having a photoconductive layer mounted on the surface of rotary drum 108 is sensitive to heat. If, therefore, the air flow which has attained a high temperature as a result of cooling original-illuminating lamp 128 contacts the surface of rotary drum 108, photosensitive member 2 is likely to be deteriorated. Furthermore, if the air flow for cooling original-illuminating lamp 128 acts on developing device 6 and cleaning device 34 provided around rotary drum 108, the fine powdery developer will be scattered by the action of the cooling air flow. It is likely therefore that the apparatus will be soiled or the resulting toner image will be distorted.

In the preferred embodiment of the electrostatic copying apparatus of this invention described hereinabove, the upper half portion of housing 100 in which optical system 22 and suction blower 130 are provided is non-communicatively partitioned by the cooperation of partitioning plates 116, 122 and 126 and vertical transparent plate 120 from the lower half portion of housing 100 in which rotary drum 108 and developing device 6 and other components around rotary drum 108 are provided. Accordingly, the air which is sucked by suction blower 130 through suction opening 132 and discharged from discharge opening 138 to cool original-illuminating lamp 128 does not flow into the lower half portion. Consequently, there is no likelihood of the deterioration of photosensitive member 2 by the hot air flow, or of the soiling of the apparatus and the distortion of the toner image by the scattering of the toner particles.

In the preferred embodiment of the electrostatic copying apparatus of this invention, partitioning plate 122 is provided which has a portion extending from the upper edge of discharge opening 138 formed on the right-hand end wall of housing 100 substantially horizontally into the inside of housing 100 for a fixed distance. Partitioning plate 122 has opening 124 for the air flow. Accordingly, the air flow for cooling is discharged through opening 124 and discharge opening 138, but the light from illuminating lamp 128 is mostly shielded by the part of partitioning plate 122 and the right-hand wall of housing 100 which are at right angles to each other. Hence, the light from lamp 128 does not leak from housing 100, and therefore, is not likely to affect the eyes of the operator. To prevent light leakage from lamp 128 completely, a plurality of shielding plates (not shown) inclined at a fixed angle may be provided at intervals at opening 124 and/or discharge opening 138.

Partitioning plates 116, 122, etc. also have the effect of reinforcing housing 100 and increasing its rigidity.

In the embodiment shown in the drawings, vertical transparent plate 120 is provided at a position spaced to the left from opening 118 of partitioning plate 116 a fixed distance. Alternatively, transparent plate 120 may be provided directly at opening 118 of partitioning plate 116. In this case, the upper half portion of housing 100 including optical system 22 and suction blower 130 is separated from and out of communication with the lower half portion including rotary drum 108 and developing device 6 and other component parts around the drum only by means of partitioning plate 116 and transparent plate 120 provided at opening 118. If desired, therefore, auxiliary partitioning plate 122 can be omitted. If, however, the provision of auxiliary partitioning plate 122 is omitted, a considerable amount of the light from lamp 128 of optical system 22 leaks from housing 100 through discharge opening 138. Furthermore, it is likely that the light from outside housing 100 will fall upon in-mirror lens 144 to produce optical noise in the optical system 22. Accordingly, when auxiliary partitioning plate 122 is to be omitted, it is desirable to provide a plurality of light shielding plates inclined at a fixed angle at intervals in discharge opening 138.

Instead of providing transparent plate 120 at opening 118 of partitioning plate 116, one or a plurality of air jet nozzles may be provided near opening 118 so that the upper portion of housing 100 is separated from the lower portion at opening 118 by the action of an air flow which flows somewhat upwardly into opening 118 from the tips of the air jet nozzles (by a so-called air curtain action). The pressure of the air flow from the air nozzle needs to be equal to, or somewhat higher than, the pressure of the cooling air stream which would flow from the upper portion to the lower portion of housing 100 through opening 118 in the absence of such air flow from air nozzles. When such an air nozzle is provided and transparent plate 120 having the same refractive index as transparent plate 102 on which to place an original is absent in the ligh path extending from in-mirror lens 114 of optical system 22 (the optical system 22 will be described in detail hereinbelow) to the surface of rotary drum 108, this light path must be adjusted to include the light path that would be increased by the refractive index of transparent plate 102. If further desired, instead of providing an air curtain as described above, the flowing of the air stream from the upper portion to the lower portion of the housing can be blocked by providing a suitable sucking means in the lower portion of housing 100 to maintain the air pressure in the lower portion somewhat higher than the air pressure of the upper portion of the housing.

OPTICAL SYSTEM

Figure 9:
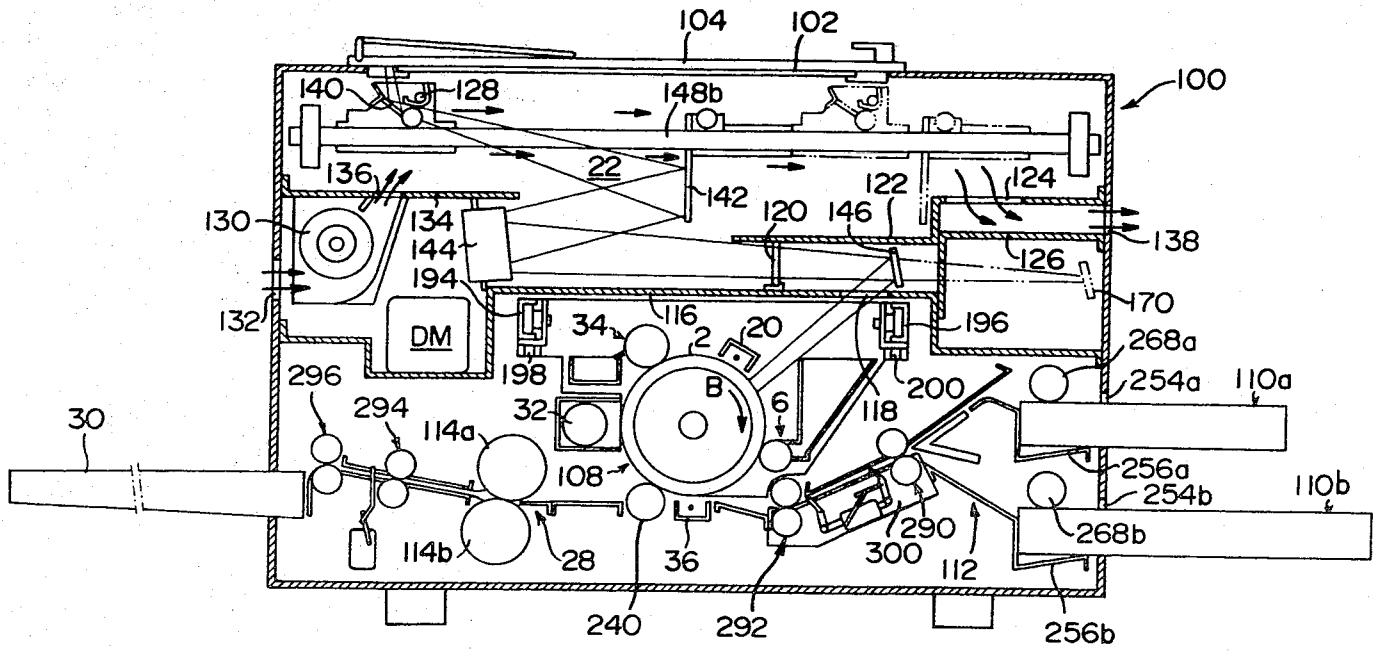
FIG. 9 is a section view of the electrostatic copying apparatus shown in FIG. 8.
Figure 10:
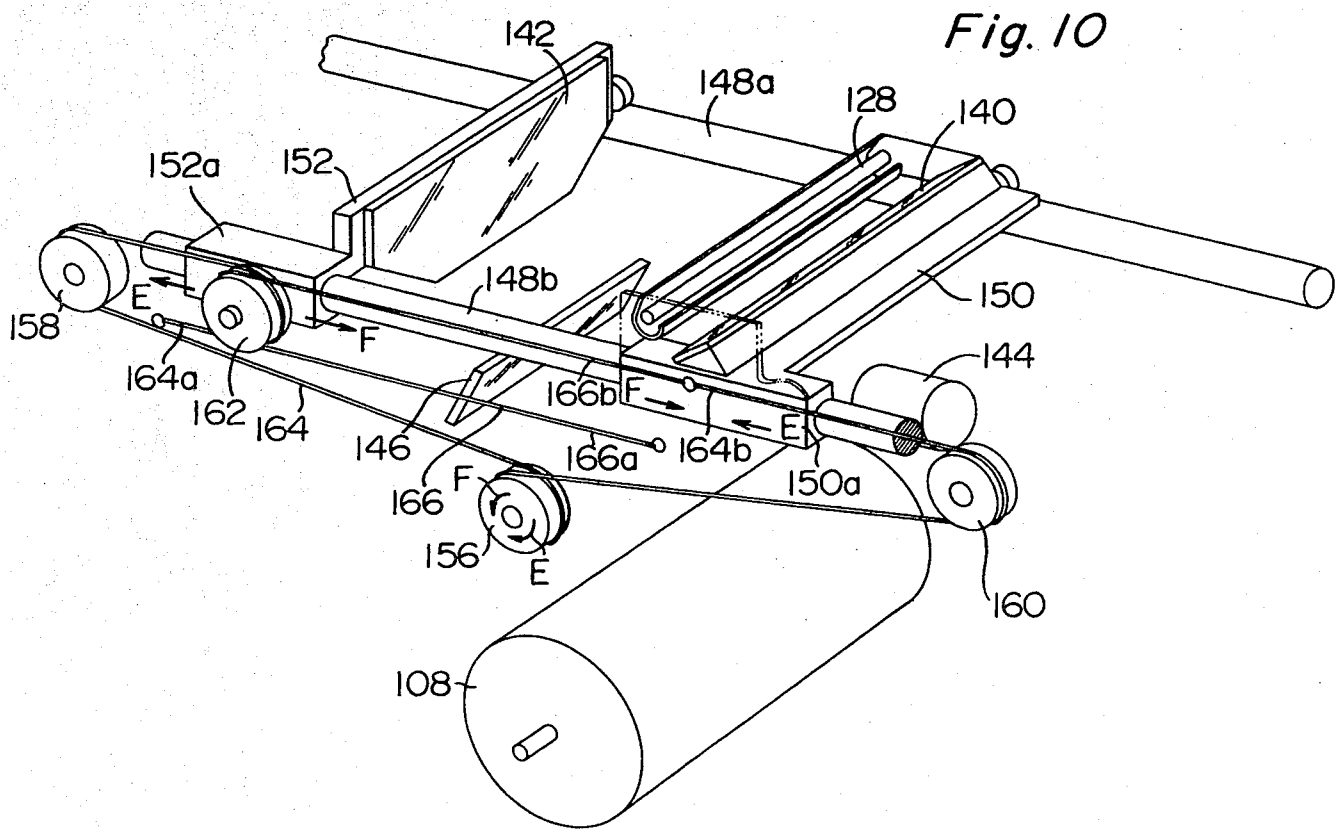
FIG. 10 is a simplified partially perspective view showing an optical system.

Now, referring to FIGS. 9 to 11, the optical system is described in detail.

Optical system 22 includes original-illuminating lamp 128, first reflecting mirror 140, second reflecting mirror 142, in-mirror lens 144, and third reflecting mirror 146. Illuminating lamp 128 and first reflecting mirror 140 are secured to first support frame 150 and are slidably mounted on a pair of suspending rods **148*a* and 148*b* which extend substantially horizontally in the upper half portion of the space between from vertical base plate 101 and rear vertical base plate 103. Second reflecting mirror 142 is secured to second support frame 152 mounted slidably on suspending rods 148*a* and 148*b*. In-mirror lens 144 is secured at a fixed position between partitioning plates 116 and 134. Third reflecting mirror 146 is secured at a predetermined position between partitioning plates 116 and 122**.

First support frame 150 to which lamp 128 and first reflecting mirror 140 are secured is reciprocable between the position shown by the solid lines in FIG. 9 and the position shown by the two-dot chain lines in FIG. 9, and second support frame 152 to which second reflecting mirror 142 is secured is reciprocable at a speed half of the speed of first support frame 150 between the position shown by the solid lines and the position shown by two-dot chain lines shown in FIG. 9.

With particular reference to FIG. 10, a drive mechanism for driving first support frame 150 and second support frame 152 in this manner will be described. On rear vertical base plate 103 (see FIG. 11) provided in housing 100, are mounted pulley 156 to be driven by a motor via a drive system to be described, and first follow-up pulley 158 and second follow-up pulley 160. Third follow-up pulley 162 is rotatably provided in second support frame 152. First wire 164 and second wire 166 are wrapped around these pulleys in the following manner. First wire 164 which has one end **164*a* fixed to rear vertical base plate 103 and is first wrapped about the first follow-up pulley 158, then about pulley 156 and further about second follow-up pulley 160, and the other end 164*b* is fixed to first support frame 150. Second wire 166 has one end 166*a* fixed to rear vertical base plate 103 and is wrapped about third follow-up pulley 162, and the other end 166*b* is fixed to first support frame 150**.

Thus, when pulley 156 is rotated in the direction of arrow E at a fixed speed, first support frame 150 is moved in the direction of arrow E at the peripheral speed of pulley 156. Second support frame 152 is moved in the direction of arrow E at a speed one half of the above peripheral speed. When pulley 156 is rotated in the direction of arrow F at a fixed speed, first support frame 150 is moved in the direction of arrow A at the same peripheral speed as pulley 156, and second support frame 152 is moved in the direction of arrow F at a speed half of the peripheral speed of pulley 156.

Optical system 22 successively scans the image of the original placed on transparent plate 102 and projects it onto the surface of drum 108 while first support frame 150 moves from the position shown by the solid lines to the position shown by the two-dot chain lines at the same moving speed as the moving speed of the periphery of rotary drum 108 and second support frame 152 moves from the position shown by the solid lines to the position shown by the two-dot chain lines at a speed half of the moving speed of the periphery of rotary drum 108. First support frame 150 and second support frame 152 may be constructed such that if desired, they can be returned at faster speeds than their moving speeds mentioned above from the position shown by the two-dot chain lines to the position shown by the solid lines.

The path of the light reflected from the original illuminated by lamp 128 secured to first support frame 150 is briefly described. The reflected light from the original first passes through transparent plate 102 and reaches first reflecting mirror 140. It is reflected by first reflecting mirror 140, and reaches second reflecting mirror 142 where it is further reflected. The reflected light is then reflected onto the mirror within in-mirror lens 144, passes through vertical transparent plate 120, and reaches reflecting mirror 146. It is reflected by third reflecting mirror 146, and reaches the surface of rotary drum 108. When the original is scanned by lamp 128, first reflecting mirror 140 and second reflecting mirror 142 while first support frame 150 and second support frame 152 move, lamp 128 and first reflecting mirror 140 move at the same speed as the peripheral speed of rotary drum 108, whereas second reflecting mirror 142 moves at a speed half of this speed. Accordingly, throughout the entire step of scanning the original, the optical length from the original to in-mirror lens 144, and the optical length from in-mirror lens 144 to the surface of rotary drum 108 are always maintained substantially constant. If vertical transparent plate 120 has the same thickness and is of the same material as transparent plate 102 on which the original is place, the influence (i.e., the refractive index) of transparent plate 102 on the light path extending from the original to the lens of in-mirror lens 144 becomes equal to the influence (i.e., the refractive index) of vertical transparent plate 120 on the light path extending from the lens of in-mirror lens 144 to the surface of rotary drum 108. Accordingly, the individual elements of optical system 22 can be positioned without consideration of the effects of transparent plate 102 and vertical transparent plate 120 on the light paths.

In optical system 22 in which first reflecting mirror 140 and second reflecting mirror 142 move at different speeds along a pair of suspending rods 148*a* and 148*b*, the distance between the reflecting mirrors changes according to the position of first support frame 150 to which first reflecting mirror 140 is fixed and second support frame 152 to which second reflecting mirror 142 is secured. Accordingly, at the time of fixing the two ends of each of first wire 164 and second wire 166 at fixed positions or at the time of replacing the wires 164 and 166, it is quite difficult to position first support frame 150 and second support frame 152 in a fixed relation on suspending rods 148*a* and 148*b* so that the optical length from the original to in-mirror lens 144 is equal to the optical length from in-mirror lens 144 to the surface of rotary drum 108.

However, according to the optical system 22 in the preferred embodiment of the electrostatic copying apparatus of this invention, first support frame 150 and second support frame 152 mounted slidably on suspending rods 148*a* and 148*b* can be positioned in a fixed relation very easily and rapidly, and the two ends of first wire 164 and/or second wire 166 can be fixed at predetermined positions.

In optical system 22 in accordance with the preferred embodiment of the electrostatic copying apparatus of this invention, a part of first support frame 150, for example block portion 150*a* having a hole through which rod 148*b* extends, and a part of second support frame 152, for example block portion 152*a* having a hole through which rod 148*b* extends, are formed in a predetermined dimension. These block portions 150*a l and* *152a* cooperate with a suitable stop member, for example support bracket 168 (see FIG. 11) secured to the right-hand end portion of rear vertical base plate 103 and supporting the right-hand end portion of suspending rod 148*b*, thereby to form a positioning means for first support frame 150 and second support frame 152. Specifically, optical system 22 shown in the drawings is constucted such that first support frame 150 and second support frame 152 can be suitably positioned in a fixed relation by contacting the right-hand end of block portion 152*a* of second support frame 152 with the left-hand end of support bracket 168 and contacting the right-hand end of block portion 150*a* of first support frame 150 with the left end of block portion 152*a* of second support frame 152. Accordingly, in assembling the apparatus, block portion 150*a* of first support frame 150, block portion 152*a* of second support frame 152 and support bracket 168 are connected with each other as described hereinabove, and the ends of first wire 164 and/or second wire 166 are fixed to predetermined positions on rear vertical bas plate 103 and first support frame 150. Thus, first support frame 150 and second support frame 152 are held so that they can move in a fixed relation to each other. Then, first support frame 150 and second support frame 152 can be moved to the starting position of scanning shown, for example, by the solid lines in FIG. 9.

According to the preferred embodiment of the electrostatic copying apparatus in accordance with this invention, optical system 22 is constructed such that the positioning of in-mirror lens 144, namely focus adjustment, can be performed more easily than in conventional optical systems.

According to the prior techniques, the positioning of in-mirror lens 144 is performed by first observing an image projected on the surface of rotary drum 108 to determine whether the image of the original placed on transparent plate 102 has been formed correctly on the surface of rotary drum 108, and then meticulously adjusting the position of in-mirror lens 144 according to the result of this observation. It is relatively difficult however to observe the surface of rotary drum 108 while meticulously adjusting the position of in-mirror lens 144, because rotary drum 108 is disposed substantially centrally in housing 100 and the various devices provided around the drum will block vision beyond the surface of rotary drum 108.

In optical system 22 in accordance with the preferred embodiment of the electrostatic copying apparatus of this invention, a semi-transparent image-focusing plate (member 170 shown by the two-dot chain line in FIG. 9) made, for example, of ground glass can be temporarily fixed at a position spaced from the surface of third reflecting mirror a distance the same as the optical length extending from the surface of third reflecting mirror 146 of rotary drum 108.

In this optical system 22, in-mirror lens 144 can be positioned relatively easily by temporarily fixing image focusing plate 170 before the right-hand end wall of housing 100, partitioning plate 126 and third reflecting mirror 146 are mounted. By so doing, the image of the original placed on transparent plate 102 is projected onto image focusing plate 170. Since image-focusing plate 170 is positioned near the right-hand end wall of housing 100 (the wall is not mounted when positioning in-mirror lens 144) and is made of a semi-transparent material such as ground glass, the image of the original projected on the focal plane of image focusing plate 170 can be observed easily from outside the right-hand end wall of housing 100 (in FIG. 9). Accordingly, the position of in-mirror lens 144 can be easily adjusted meticulously while observing the image of the original projected onto the focal plane of image focusing plate 170. Image focusing plate 170 is mounted at such a position that the optical distance from the surface of third reflecting mirror 146 to be provided later to the focal plane of image focusing plate 170 is equal to the distance from the surface of third reflecting mirror 146 to that portion of rotary drum 108 onto which the image of the original will be projected. Hence, if in-mirror lens 144 is fixed correctly at a position at which the image of the original is correctly formed on the focal plane of image focusing plate 170, and third reflecting mirror 146 can be mounted later, and the image of the original will be correctly formed on the surface of rotary drum 108.

After in-mirror lens 144 has been positioned and fixed, image focusing plate 170 is removed, and then third reflecting mirror 146, partitioning plate 126 and the right-hand end wall of housing 100 are mounted. The space between partitioning plates 126 and 116 in which image focusing plate 170 is temporarily fixed is utilized as a space for accommodating electrical means for operating and controlling various component parts of the electrostatic copying apparatus.

ROTARY DRUM AND VARIOUS DEVICES PROVIDED AROUND IT

Referring to FIGS. 8, 9 and 12 to 14, rotary drum 108 and corona discharge device 20, developing device 6, corona discharge device 36, static eliminating lamp 32 and cleaning device 34 disposed around rotary drum 108 are described below in detail.

In a preferred embodiment of the electrostatic copying apparatus of this invention, a support generally shown at 172 is secured to front vertical base plate 101 and rear vertical base plate 103 centrally beneath partitioning plate 116 in a manner such that it is freely slidably in the forward and rearward directions (the direction perpendicular to the plane of the drawing of FIG. 9). To support 172 are secured rotary drum 108, corona discharge device 20 for charging, developing device 6 and cleaning device 34.

Figure 12:
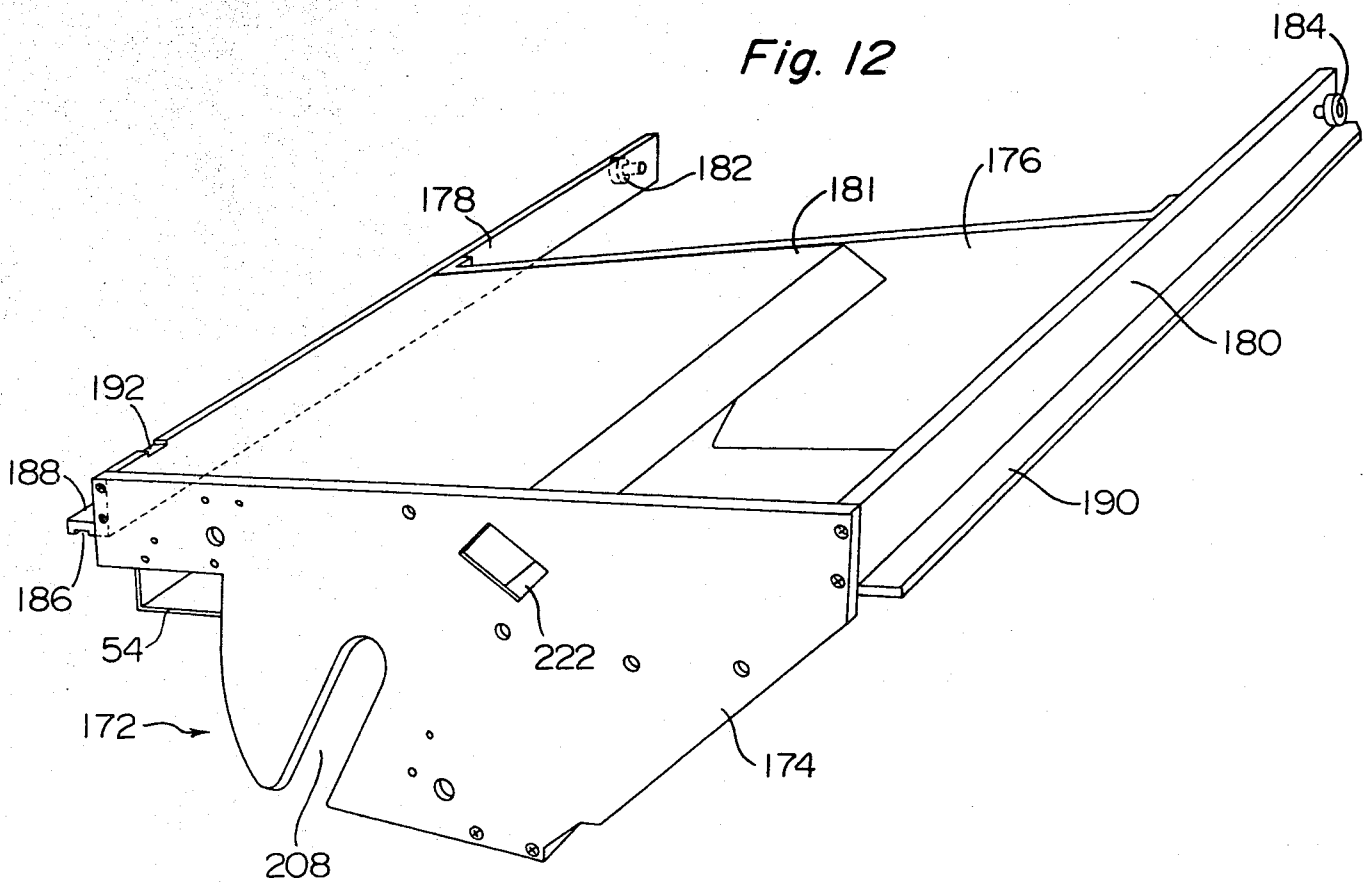
FIG. 12 is a perspective view showing a support structure.

Referring to FIGS. 12 and 13, support 172 includes vertical front plate 174 and vertical rear plate 176 arranged substantially parallel to each other with a distance therebetween corresponding nearly to the distance between front vertical base plate 101 and rear vertical base plate 103, and a pair of horizontal members 178 and 180 which extend from both side portions of vertical front plate 174 substantially horizontally over vertical rear plate 176. Preferably, support 172 further includes cover 181 which is removably secured and covers the left portion of the top of support 172. Guide rolls 182 and 184 are mounted on the rear ends of horizontal member 187 and 180 respectively which extend beyond vertical rear plate 176. Guide rail 188 having groove 186 in its bottom surface is secured to horizontal member 178. Flat guide rail 190 is secured to horizontal member 180. Furthermore, notch 192 is provided in the upper edge of horizontal member 178 near its forward end.

Front vertical base plate 101 has opening 195 having a shape corresponding to the shape of support 172 so that support 172 can be set at a predetermined operating position through opening 195. A pair of channel-like guide rails 194 and 196 (see FIGS. 14, 13 and 9) are fixed to front vertical base plate 101 and rear vertical base plate 103. Guide rails 194 and 196 which extend rearward from front vertical base plate 101 to rear vertical base plate 103 receive and guide the guide rolls 182 and 184 mounted on the rear ends of horizontal members 178 and 180 of support 172. Guide roll 198 adapted to be engaged with groove 186 of guide rail 188 and guide roll 200 adapted to be engaged with the bottom surface of guide rail 190 are rotatably mounted respectively on the front vertical base plate 101 near the forward ends of guide rails 194 and 196. At the upper portion of guide rail 194 near its forward end is provided locking means 202 (see FIG. 11) which cooperates with notch 192 of horizontal member 178. Locking means 202 secured to partitioning plate 116 may be of any known type, and includes an engaging member (not shown) which is elastically restained by an elastic means such as a spring, extends downward through the openings formed in partitioning plate 116 and guide rail 194, and comes into engagement with notch 192, and operating part 204 which by hand operating, can lift the engaging member.

It will be appreciated therefore that support 172 is mounted so that it is slidable in the forward and rearward directions (the direction perpendicular to the plane of FIG. 9) through opening 195 formed in front vertical base plate 101. Briefly stated, support 172 is mounted slidably by engaging guide rolls 182 and 184 with guide rails 194 and 196 and guide rails 188 and 190 with guide rolls 198 and 200. When support 172 is moved rearward and reaches the operating position (i.e., the position at which vertical front plate 174 is situated substantially in the same plane as front vertical base plate 101, and vertical rear plate 176 is situated adjacent rear vertical base plate 103), locking means 202 and notch 192 cooperate to lock support 172 releasably. To pull out the support forward and if desired, remove it from housing 100, operating part 204 of locking means 202 is operated to release the cooperation of locking means 202 and notch 192, and support 172 is caused to slide forward.

Rotary drum 108, corona discharge device 20, developing device 6 and cleaning device 34 are mounted on suport 172 described above.

Referring to FIGS. 12 to 15, the mounting of rotary drum 108 on support 172 will be described. In each of vertical front plat 174 and vertical rear plate 176 of support 172 is formed a slot 208 extending upward from the lower edge of each of plates 174 and 176 to its central part in a somewhat inclined manner. Slot 208 is adapted to receive shaft support member 218 rotatably fitted in each end portion of shaft 206 of rotary drum 108 through a suitable means such a ball bearings. Shaft 210 is rotatably secured to vertical front plate 174 and vertical rear plate 176 of support 172, and rotary drum-holding lever 212 for supporing shaft support member 218 in place is secured to each of the forward end of shaft 210 which projects forward beyond vertical front plate 174 and the rear end of shaft 210 which projects rearward beyond vertical rear plate 176.

Rotary drum 108 can be mounted on, and removed from, suport 172 in the following manner. To mount rotary drum 108 on support 172, holding lever 212 is turned clockwise a suitable angle from the position shown in FIG. 13 to position it at a point at which it does not interfere with slot 208. Then, rotary drum 108 is fitted into support 172 from below, and shaft supporting members 218 fitted in the end portions of shaft 206 are inserted into slots 208. Holding levers 212 are then turned to the positions shown in FIG. 13, and fixed in position by such a means as screws 213. As a result, shaft supporting member 128 fitted in both end portions of shaft 206 of rotary drum 108 is supported in a substantially circular hole defined by the hook-like forward end of holding lever 212 and the semi-circular upper end of slot 208 To remove rotary drum 108 from support 172, the screws 213 holding levers 212 are removed, and holding lever 212 are turned clockwise from the positions shown in FIG. 13. The rotary drum 108 is moved downward along slots 208. To the rearmost end of shaft 206 of rotary drum 180 is fixed joint 217 which is adapted to be drivingly connected to joint 216 rotatably mounted on rear vertical base plate 103 (joint 216 is rotated by a motor through a drive system to be described below in detail). Joints 216 and 217 may be of any known type, and are adapted to be connected to each other when their angular positions are in agreement as prescribed. To the forward end portion of shaft 206 is fixed a grip knob 220 which the operator can grip when pulling out or removing support 172 from housing 100 or when mounting or removing rotary drum 108. Grip knob 220 (see FIG. 8 also) is connected to shaft 206 via a known one-way clutch placed therein, and can rotate rotary drum 108 and its shaft 206 only when turned in the predetermined rotating direction of the rotary drum 108 (i.e., the direction shown by arrow B—see FIG. 9). Since joints 216 and 217 are connected to each other when their angular positions are in agreement as prescribed, joints 216 and 217 must be brought into agreement by rotating rotary drum 108 and shaft 206 when mounting rotary drum 108.

As will be described in detail below, developing device 6 and developer-holding member 50 of the cleaning device 34 are adapted to be rotated when rotary drum 108 is rotated. If, therefore, rotary drum 108 could be rotated in a direction opposite to the prescribed rotating direction (the direction shown by arrow B), developing device 6 and developer-holding members 8 and 50 of cleaning device 34 would be rotated in a direction opposite to the predetermined rotating direction, and it is likely therefore that the developer contained in developer supplier 14 of developing device 6 would abnormally overflow from it, or build up on the surface of the rotary drum. However, since in rotary drum 108 shown in the drawings, securing of grip knob 220 to the forward end of shaft 206 is through the one-way clutch, even when by inadvertence in mounting rotary drum 108, grip knob 220 is rotated in a direction opposite to the predetermined direction, rotary drum 108 rotates only in the predetermined direction, and developing device 6 and cleaning device 34 cannot be rotated to produce such adverse effects as descibed above.

Corona discharge device 20 for charging is mounted detachably on support 172 by fitting it into opening 222 formed in vertical front plate 174. Mounting and detaching of corona discharge device 20 can be very easily performed by gripping grip knob 224 provided at its front end. Member 225 which constitutes a shield case for corona discharge device 20 is fixed at a position between vertical front plate 174 and vertical rear plate 176 where corona discharge device 20 is to be provided.

Developing device 6 which is preferably of the type described in detail with reference to FIG. 2 is also mounted on support 172. Developer supplier 14 in developing device 6 is fixed in place by a suitable means such as positioning pin 226 to be inserted into the front plate and the rear plate of supplier 14 through vertical front plate 174 and vertical rear plate 176 of support 172. Furthermore, as described in detail with reference to FIG. 2, developer-holding member 8 in the form of a hollow cylindrical sleeve having a roll-like permanent magnet disposed in it is pivotably supported by bearing member 227 provided at each of the front and rear plates of developer supplier 14. Pin 229 fixed to bearing member 227 is received in adjusting piece 228 adjustably mounted on vertical front plate 174 and vertical rear plate 176 of support 172. Thus, the distance between the surface of rotary drum 108 and the surface of developer-holding member 8 can be meticulously adjusted. The entire developing device 6 consisting of developer-holding member 8 and developer supplier 14 can be detached as an integral unit from support 172 by merely detaching the pin 229 in the bearing member 227 and the positioning pin 226. A developer supply opening positioned at the top of developer supplier 14 is situated at the left end of the top surface of support 172, and therefore, is open without being covered by cover 181 (FIG. 12). A brush length-adjusting member preferably of the type described hereinabove with reference to FIG. 2 is secured to developer supplier 14.

Support 172 further has cleaning device 34, preferably of the structure described in detail hereinabove with reference to FIG. 7, mounted on it. The shaft for developer-holding member 50 of cleaning device 34 is rotatably supported by the adjusting piece 230, and adjusting piece 230 is adjustably mounted on vertical front plate 174 and vertical rear plate 176. Hence, by adjusting the position of adjusting piece 230, the clearance between the surface of rotary drum 108 and the surface of developer-holding member 50 can be meticulously adjusted. Furthermore, developer-holding member 50 can be detached from support 172 by merely detaching adjusting piece 230 from vertical front plate 174 and vertical rear plate 176. Developer receiver 58 of cleaning device 34 is fixed in position between vertical front plate 174 and vertical rear plate 176 of support 172, and its forward end portion is placed on frame member 54 which, together with the lower edge of vertical front plate 174, defines a receiving opening of developer-receiver 58. A brush length-adjusting member of the type described in detail hereinabove with reference in FIG. 7 (not shown in FIG. 13) is secured to frame member 54. Receptacle 58 which is inserted through the receiving opening defined at its front portion and placed on frame member 54 can be easily mounted or detached by grasping grip knob 232 provided at its front end.

Electrostatic eliminating lamp 32 and corona discharge device 36 for transfer are mounted directly on front vertical base plate 101 and rear vertical base plate 103 at predetermined positions around rotary drum 108. As most clearly shown in FIG. 14, electrostatic eliminating lamp 32 is fixed to front vertical base plate 101 and rear vertical base plate 103 by a suitable means such as screws at a predetermined position with respect to the surface of rotary drum 108 to be mounted on support 172. Corona discharge device 36 for transfer is mounted detachably at a predetermined position with respect to the surface of rotary drum 108 to be mounted on support 172 by being fitted into notch 234 of a prescribed shape formed in front vertical base plate 101 and rear vertical base plate 103. Corona discharge device 36 can be very easily mounted and detached by grasping grip knob 236 provided at its front end.

As best shown in FIG. 14, member 40 for peeling a receptor sheet is fixed to rear vertical base plate 103 via fixing bracket 238 at a position which is adjacent corona discharge device 36 downstream of the moving direction of the surface of rotary drum 108 and is near the rear end of corona discharge device 36 for transfer. Member 40 serves to peel a receptor sheet from the surface of rotary drum 108 having a toner image thereon so as to send the receptor sheet having the toner image to fixing device 28 through a passage defined by receptor sheet conveying roller 240 and receptor sheet guide plate 42. The receptor sheet peeled off the rotary drum 108 by the action of peeling member 40 is acted on by peel roller 241 (see FIG. 19) which cooperates with conveying roller 240 and is fed onto guide plate 42. To peel the firmly adhering receptor sheet from the surface of rotary drum 108 precisely, it is preferred to make peeling member 40 such that its forward end 40*a* is engaged with the edge of the receptor sheet projecting from the surface of rotary drum 108. This can be achieved by making the rear end of rotary drum 108 smaller in diameter than the remainder (the surface of the smaller-diameter portion is not utilized for the formation of an electrostatic latent image and a toner image), or by somewhat decreasing the width of rotary drum 108.

In the electrostatic copying apparatus of the type described hereinabove for performing the electrostatic copying process described above with reference to FIG. 5, the developer contained in developer supplier 14 is consumed as the copying process is performed. Hence, the developer must be supplied occasionally to supplier 14. Furthermore, as the copying process proceeds, the developer removed from the surface of rotary drum 108 builds up in receptacle 58 of cleaning device 34. Hence, the developer in receptacle 58 must be occasionally recovered. On the other hand, as described in detail hereinabove with reference to FIG. 2, in order to perform the developing step effectively, it is important to maintain distance $d_2$ between the surface of developer-holding member 8 and the surface of rotary drum 108 and distance $d_1$ between the developer-holding member 8 and the forward end of brush length-adjusting member 16 secured to developer supplier 14 at suitable values. Furthermore, as already described with reference to FIG. 7, to perform the cleaning step effectively, it is important to maintain distance $d_4$ between the surface of developer-holding member 50 and the surface of rotary drum 108, and distance $d_5$ between the surface of developer-holding member 50 and the forward end of brush length-adjusting member 56 at suitable values.

In the preferred embodiment of the electrostatic copying apparatus of this invention described above, developing device 6 together with rotary drum 108 is mounted on support 172 which is mounted on front vertical base plate 101 and rear vertical base plate 103 in a manner such that it is slidable in the forward and rearward directions, and the supply opening of developer supplier 14 of developing device 6 is opened upward. Hence, supplying of the developer to developer supplier 14 can be performed by merely pulling support 172 forward and feeding the developer through the supply opening. Thus, it is not necessary to construct the apparatus such that for supplying the developer, the entire developing device 6 must be caused to slide forward with respect to rotary drum 108, or developer supplier 14 to slide forward with respect to developer-holding member 8 of developing device 6. If the apparatus is constructed in this way, as in a conventional electrostatic copying apparatus, it is extremely difficult, if not impossible, to maintain distance $d_2$ exactly at a predetermined value, and distance $d_2$ is likely to be changed by the sliding of the entire developing device 6 or developer supplier 14 in the forward and rearward directions.

In the preferred embodiment of the electrostatic copying apparatus in accordance with this invention, cleaning device 34 is also mounted on support 172, and only the receptacle 58 of cleaning device 34 is adapted to be moved forward of support 172 and pulled out. Hence, the developer that builds up in receptacle 58 can be rapidly and easily recovered without any adverse effect on distance $d_4$ by merely pulling receptacle 58 forward. There is no need to construct the apparatus such that in recovering the developer, the entire cleaning device 34 must slide forward with respect to rotary drum 108, or frame member 54 having brush length-adjusting member 56 fitted thereto must slide forward with respect to developer-holding member 50 of cleaning device 34. Accordingly, distance $d_4$ can be maintained exactly at a predetermined value.

Furthermore, in the preferred embodiment of the electrostatic copying apparatus of this invention, as can be easily understood from FIGS. 9 and 14, when support 172 is pulled out by forward sliding, a transfer station having corona discharge device 36 and a receptor sheet passage nearby (the receptor sheet conveying system and the receptor sheet passage in their entirety will be described hereinbelow) are directly exposed. Thus, any receptor sheet which jams up at these portions can be easily removed.

Since corona discharge device 20 is mounted detachably on support 172 and corona discharge device 36 is mounted detachably on front vertical base plate 101 and rear vertical base plate 103, they can be very easily repaired, cleaned or replaced in the event they are damaged, cut off or soiled. Support 172 having developing device 6, cleaning device 34 and corona discharge device 20 mounted on it, when pulled out to a predetermined position, is blocked by a suitable blocking member to check further forward movement and thus to prevent inadvertent dropping of support 172. It is also possible to construct the apparatus such that support 172 can be completely detached from housing 100 by somewhat lifting it after it has been pulled out to a predetermined position. Support 172 completely detached from housing 100 in this way can be placed temporarily on an auxiliary frame (not shown) which can hold support 172 by engagement with bottom surfaces of guide rails 188 and 190.

FIG. 13-A shows a modified example of a support which is mounted on front vertical base plate 101 and rear vertical base plate 103 so that it is slidable in the forward and rearward directions (i.e., the direction perpendicular to the plane of the drawing of FIG. 9) and a rotary drum, a developing device and a cleaning device which are mounted on the support.

The support shown generally at 472 in the modified example shown in FIG. 13-A includes vertical front plate 474 and vertical rear plate 476 which are disposed substantially parallel to each other with an interval therebetween corresponding to the distance between front vertical base plate 101 and rear vertical base plate 103, and a pair of channel-like horizontal members 478 and 480 which extend substantially horizontally from both side portions of vertical front plate 474 beyond vertical rear plate 476. Horizontal members 478 and 480 of support 472 are slidably engaged respectively with a pair of guide rails 494 and 496 which are slidably received in a pair of guide rails 493 (only one of them is shown in the drawing) extending backward from front vertical base plate 101 (not shown in FIG. 13-A) beyond rear vertical base plate 103. This causes support 472 to be mounted on front vertical base plate 101 and rear vertical base plate 103 so that it is slidable in the forward and rearward directions. Locking means 502 of any known type is provided in the inside upper edge portion of vertical front plate 474 of support 472. Locking means 502 is elastically and releasably engaged with part 195*a* of opening 195 of front vertical base plate 101 when support member 472 is inserted and reaches an operating position where vertical front plate 474 is situated substantially in the same plane as front vertical base plate 101 and vertical rear plate 476 is adjacent rear vertical base plate 103.

Rotary drum 108, corona discharge device 20 for charging, developing device 706 and cleaning device 734 are mounted on support 472.

Rotary drum 108 shown in FIG. 13-A is constructed such that cylindrical body 409 having a photosensitive material on its surface can be easily detached as required. Specifically, rotary drum 108 shown in FIG. 13-A has support shaft 406 and a pair of discs 410 and 412 rotatably mounted on support shaft 406 by bearing means 407. Discs 410 and 412 are connected to each other by a plurality (three in the drawing) of stays 414 arranged in spaced relationship in the circumferential direction. To disc 412 is fixed gear 344 which is to mesh with gear 354 of developing device 706 and gear 348 of cleaning device 734, as will be described in detail hereinbelow with reference to FIG. 19. Cylindrical body 409 having photosensitive coating 2 has discs 410 and 412 and stays 414 inserted in an annular recess formed in the inside part of the end of cylinder 409, and held in position by disc 416 fixed in disc 410 by a plurality of screws 415.

In the modified example shown in FIG. 13-A in which support shaft 406 is supported on bearing means 407, it is not necessary to maintain the linearity of the axis of shaft 406*a* precisely over its entire length. In other words, the shaft is easy to make since it is sufficient to finish only that part of shaft 406 at which to locate bearing means 407 within the range of predetermined linearity.

Rotary drum 108 having the above construction is detachably mounted on support 472 by detachably fixing support shaft 406 to vertical front plate 474 and vertical rear plate 476 of support 472. In each of vertical front plate 474 and vertical rear plate 476 is formed slot 408 extending upwardly from the lower edge of each plate to its center in a somewhat inclined manner. Each slot 408 has part 408*a* having a width smaller than the diameter of support shaft 406 by a predetermined dimension and circular part 408*b* having its center somewhat offset with respect to the longitudinal axial line of the part 408*a* and having substantially the same diameter as the diameter of support shaft 406. Chord-like groove 405 having a width corresponding to each of vertical front plate 474 and vertical rear plate 476 is formed at both end portions of support shaft 406. Notch 404 is formed at the forward end portion of support shaft 406 to indicate the position of groove 405. To mount rotary drum 108 on support 472, support shaft 406 is placed in the position shown in FIG. 13-A in which its grooves 405 receive vertical front plate 474 and vertical rear plate 476 of support 472 respectively, and inserted into slot 408 up to the part 408*b* via part 408*a*. Then, support shaft 406 is turned counterclockwise in FIG. 13-A to direct grooves 405 at both its ends downward. Next, stop 413 having projecting portion 413*a* engagable with groove 405 is fixed only to vertical front plate 474 by means of screws 417 to block the rotation of support shaft 406, thereby to mount support shaft 406 and rotary drum 108 exactly at predetermined positions on support 472. Rotary drum 108 can be detached from support 472 by reversing the above procedure. When rotary drum 108 has been mounted at a predetermined position on support 472 and support 472 is inserted to a predetermined position (i.e., the position at which vertical front plate 474 is situated in substantially the same plane as front vertical base plate 101 and vertical rear plate 476 is adjacent rear vertical base plate 103), gear 344 of rotary drum 108 is drivingly connected to a drive system to be described. The driving connection of gear 344 to the drive system can be achieved, for example, by pivotably supporting a shaft (not shown) to be rotated by the drive system on rear vertical base plate 103, and meshing a gear (not shown) with gear 344 at the forward end portion of this shaft which extends beyond vertical rear plate 476.

In rotary drum 108 shown in FIG. 13-A, the cylindrical body 409 has at both ends parts 409*a* and 409*b* having no photosensitive coating 2, and small-diameter part 409*c* adjacent part 409*a*. The small-diameter part 409*c* is located at a position corresponding to the position of peeling member 440 fixed to the inside surface of vertical front plate 474. Peeling member 440 has the same function as peeling member 40 already described hereinabove, and acts to peel off a firmly adhering transfer sheet from the surface of rotary drum 108. In the embodiment shown in FIG. 13-A, peeling member 440 is fixed to the inside surface of vertical front plate 474. Accordingly, a peeling roller (not shown in FIG. 13-A) which acts cooperatively with peeling member 440 is mounted not on rear vertical base plate 103 but on front vertical base plate 101.

Corona discharge device 20 for charging the same as in the embodiment described hereinabove with reference to FIGS. 12 and 13, is detachably mounted on support 472 by inserting it into an opening formed in vertical front plate 474.

Developing device 706 shown in FIG. 13-A includes developer supplier 714, developer-holding member 708 in the form of a hollow cylindrical sleeve fixed to the front and rear plates of developer supplier 714, and a roll-like permanent magnet (not shown) rotatably mounted by a suitable bearing within developer-holding member 708. In developing device 706 shown in FIG. 13-A, unlike developing device 6 shown in FIG. 2, developer-holding member 708 remains stationary, and the permanent magnet inside it rotates. The developer fed from developer supplier 714 onto the surface of developer-holding member 708 is moved over the surface of developer-holding member 708 by the rotation of the roll-like permanent magnet. The roll-like permanent magnet is rotated by the driving force transmitted by gear 354 fixed to a shaft (not shown) for the roll-like permanent magnet which extends through support shaft 707 integral with developer-holding member 708.

Developing device 706 of the above construction is detachably mounted on support 472 by inserting auxiliary holding pins 715 fixed to the front and rear plates of developer supplier 714 into slots 444 formed in vertical front plate 474 and vertical rear plate 476 of support 472, inserting both end portions of support shaft 707 for developer-holding member 708 into slots 446 formed in vertical front plate 474 and vertical rear plate 476, turning the stop 448 (made preferably of an elastic material) from the position shown by the solid lines to the position shown by the one-dot chain lines and putting it on a pin and fixing it there to hold support shaft 707 in slots 446. Accordingly, both developer supplier 714 and developer-holding member 708 can be removably mounted on support 472 very easily. The distance between the surface of rotary drum 108 and the surface of developer-holding member 708 is prescribed as desired by contacting a pair of rings 711 rotatably mounted on both end portions of support shaft 707 via bearing 709 and having a diameter larger than the diameter of developer-holding member 708 by a predetermined dimension, with parts 409*a* and 409*b* at both ends of rotary drum 108.

Cleaning device 734 illustrated in FIG. 13A includes support frame 754, developer-holding member 750 in the form of a hollow cylindrical sleeve fixed to support frame 754, rolllike permanent magnet 749 rotatably mounted within developer-holding member 750 by a suitable bearing means (not shown), and developer receiver 758. In cleaning device 734 having this structure, substantially the same as with the developing device 706, developer-holding member 750 remains stationary, and magnet 749 is rotated by the driving force transmitted by gear 348 fixed to a shaft (not shown) for magnet 749 which extends through the inside of support shaft 751 integral with developer-holding member 750.

Cleaning device 734 having the construction described above is detachably mounted on support 472 in the following manner. Auxiliary holding pins 755 fixed to the two ends of support frame 754 are inserted into slots 482 formed in vertical front plate 474 and vertical rear plate 476. A portion of support shaft 751 which is near each end is inserted into slot 484 formed in each of vertical front plate 474 and vertical rear plate 476, and each of stops 486 preferably made of an elastic material is turned from the position shown by the solid lines to the position shown by the one-dot chain lines, put on a pin and fixed there to hold support shaft 751 within slots 484. As a result, both support frame 754 and developer-holding member 750 fixed to it are detachably mounted on support 472 very easily. The distance between the surface of rotary drum 108 and the surface of developer-holding member 750 is set as prescribed by contacting a pair of rings 752 rotatably mounted on bearings 753 on the end portions of support shaft 751 and having a diameter larger than the diameter of developer-holding member 750 by a predetermined dimension, with parts 409*a* and 409*b* at both end portions of rotary drum 108 at which no photosensitive material 2 is present. Receptacle 758 is detachably mounted on support frame 754 by bringing L-shaped flange 759 formed at one edge portion of receptacle 758 into engagement with stay 761 fixed to support frame 754, and placing the bottom surface of receptacle 758 on a suitable support member (not shown) which projects from the inside surface of support frame 754. Hence, as required, the entire cleaning device 734 can be removed from support 472 with receptacle 758 remaining attached to support frame 754. Or receptacle 758 alone can be very easily detached from support 472 independently of support frame 754 and developer-holding member 750 fixed to it (i.e., without removing the entire cleaning device 734). This permits very rapid and easy inspection and maintenance.

Obviously, the developing device and the cleaning device in the preferred embodiment of the electrostatic copying apparatus of this invention described above can be fixed to, and detached from, the support very easily.

RECEPTOR SHEET CONVEYING SYSTEM

The receptor sheet conveying system 112 is described with reference to FIGS. 9, 16, 17-A and 17-B.

Receptor sheet conveying system 112 for conveying a receptor sheet consists of a cassette receiving section for receiving a part of paper cassettes 110*a* or 110*b*, and a receptor sheet conveying system for conveying a receptor sheet stacked in cassette 110*a* or 110*b* to receiving tray 30 through a transfer station having corona discharge device 36 for transfer disposed thereat and a fixing station having fixing device 28 disposed thereat.

First, the cassette receiving section is described with reference to FIGS. 16, 17-A and 17-B. Paper supplying cassettes 110*a* and 110*b* differ from each other in their sizes and in the sizes of receptor sheets stacked therein (for example, cassette 110*a* contains receptor sheets with a size of JIS-B5, and cassette 110*b* contains receptor sheets with a size of JIS-A4). Otherwise, their constructions are substantially the same, and the cassette receiving station for receiving a part of cassette 110*a* is substantially the same as the receiving section for receiving a part of cassette 110*b*. The following description, therefore, is directed mainly to paper supplying cassette 110*a* and the cassette receiving section for receiving it.

The paper supplying cassette 110*a* is composed of substantially rectangular parallelpipedal case 242*a* with an open top, and case 242*a* includes auxiliary bottom plate 244*a* made of relatively rigid material such as cardboard, metal or synthetic resin and layer 246*a* of receptor sheets of a predetermined size (for example, B5). In FIG. 16, bottom plate 244*a* and receptor sheet layer 246*a* are omitted. Fitting lever-receiving recess 248*a* is formed in both sides of case 242*a*, and opening 250*a* for receiving receptor sheet-lifting lever 286*a* is formed centrally near the forward end of the bottom plate of case 242*a*. Blocking members 252*a* for blocking the forward end of a receptor sheet are fixed to the top end of each corner of case 242*a* at its forward end. Wedge-shaped notch 253*a* is formed in the upper edge of the forward portion of each side plate of case 242*a*. The operations of fitting lever-receiving recesses 248*a*, lifting lever-receiving opening 250*a*, blocking members 252*a* and notches 253*a* will be described in detail hereinbelow.

Openings 254*a* and 254*b* are formed in the right-hand wall of housing 100 of the elastrostatic copying apparatus to receive paper supplying cassettes 110*a* and 110*b* (see FIG. 9). Inwardly of openings 254*a* and 254*b* are provided receiving member 256*a* and 256*b* (omitted in FIG. 16) which act on the front parts of the paper supplying cassettes 110*a* and 110*b* to be inserted through these openings 254*a* and 254*b*. For convenience, only one of the receiving members, 256*a*, is described. Receiving member 256*a* has a cassette bottom guiding portion 258*a* which extends downwardly and inwardly from a position immediately inwardly of opening 254*a* toward the inside of housing 100 and guides the bottom surface of paper supplying cassette 110*a* inserted through opening 254*a*, cassette end abutting portion 260*a* which the forward end of paper supplying cassette 110*a* to be inserted through opening 254*a* abuts, and receptor sheet guiding portion 262*a* which further extends toward the inside of housing 100 from the top end of abutting portion 260*a* and guides the receptor sheet fed from cassette 110*a* to the receptor sheet conveying system, as will be described hereinbelow.

At a position above cassette bottom guiding portion 258*a* and a predetermined distance from it, is a shaft 266*a* to be rotated selectively in the direction of arrow E (in the clockwise direction in FIGS. 16, 17-A and 17-B) by the action of clutch MC3 which may be an electromagnetic clutch or a combination of a rotary spring clutch and an electromagnetic solenoid. Shaft 266*a* is mounted rotatably on front vertical base plate 101 and rear vertical base plate 103. A pair of paper feed rollers 268, for example, are secured to shaft 266*a*. A pair of stop plates 270*a* with wedge-shaped notches 253*a* formed in the paper supplying cassette 110*a* come into engagement are fixed to front vertical base plate 101 and rear vertical base plate 103 at a position above cassette bottom guiding portion 258*a*.

Immediately inwardly of receiving member 256*a*, shaft 272*a* is rotatably mounted on front vertical base plate 101 and rear vertical base plate 103. A substantially fan-shaped positioning member 274*a* is fixed to one end (the forward end in FIG. 16) of shaft 272*a*. Near shaft 272*a* is disposed a stop pin 276*a* fixed to front vertical base plate 101. A pull spring 278*a* is connected between stop pin 276*a* and that end of positioning member 274*a* which is further away from stop pin 276*a*. A pair of projecting sections 280*a* and 282*a* to be engaged with stop pin 276*a* are formed at that end of positioning member 274*a* which is nearer stop pin 276*a*, and that portion of positioning member 274*a* which is between two projecting sections 280*a* and 282*a* forms an arc having a predetermined radius of curvature. The stop pin 276*a*, positioning member 274*a* and pull spring 278*a* are constructed such that they operate as follows:

In the state shown in FIGS. 16 and 17-A in which one projecting section 280*a* of positioning member 274*a* comes into engagement with stop pin 276*a*, shaft 272*a* is urged in the clockwise direction of the elastic action of pull spring 278*a*, and therefore, shaft 272*a* is set in position by the engagement of projecting section 280*a* with stop pin 276*a*. If, as described hereinbelow, shaft 272*a* is turned counterclockwise in FIGS. 16 and 17-A against the action of pull spring 278*a* as a result of operating the paper supplying cassette 110*a*, the pull spring 278*a* retracts from its most stretched state and urges shaft 282*a* counterclockwise. Accordingly, shaft 272*a* is turned by the elastic action of pull spring 278*a* to the state illustrated in FIG. 17-B in which the other projecting section 282 of positioning member 274*a* comes into engagement with stop pin 276*a*, and is set in position. In other words, stop pin 276*a*, positioning member 274*a* and pull spring 278*a* are constructed so as to urge shaft 272*a* elastically to a first angular position at which the projecting section 280*a* comes into engagement with stop pin 276*a* (the angular position shown in FIG. 16 and 17-A), or to a second angular position at which the projecting section 282*a* comes into engagement with pin 276*a* (the angular position shown in FIG. 17-B).

To shaft 272*a* described above are fixed a pair of cassette linking levers 284*a* spaced a distance corresponding substantially to the width of paper cassette 110*a*. When cassette 110*a* is inserted into the machine by contacting its bottom surface with cassette bottom guiding portion 285*a* of receiving member 256 with shaft 272*a* being at the first angular position described above, cassette linking levers 284*a* are fitted into recesses 248*a* of cassette 110*a*. Intermediate between cassette linking levers 284*a*, receptor sheet-lifting lever 286*a* is rotatably mounted on shaft 272*a*. Receptor sheet-lifting lever 286*a* can extend through opening 250*a* formed centrally near the forward end portion of the bottom plate of cassette 110*a* and a notch (not shown) formed in receiving member 256*a* at a position corresponding to opening 250*a*, and can directly act on auxiliary bottom plate 244*a* and receptor sheet layer 246*a* placed in cassette 110*a*. When shaft 272*a* is at the first angular position, lever 286*a* is held in the position shown in FIGS. 16 and 17-A at which the forward end of lever 286*a* is retracted from opening 250*a*. When shaft 272*a* is turned to the second angular position described above, lever 286*a* is elastically urged counterclockwise in FIGS. 16, 17-A and 17-B (in a direction to lift auxiliary bottom plate 244*a* and receptor sheet layer 246*a* in cassette 110*a*) by an elastic means such as spring 288*a* with one end connected to shaft 272*a* and the other end to lifting lever 286*a*.

It is believed to be clear from the above description how the upper supplying cassette 110*a* is inserted into the cassette receiving section and how a receptor sheet is fed from the receptor sheet layer in cassette 110*a*. The operation is summarized below, however.

To insert cassette 110*a* into the receiving section through opening 254*a* formed in the right-hand wall of housing 100, it is first necessary to contact the bottom surface of cassette 110*a* with bottom guiding portion 258*a* of receiving member 256*a* and insert cassette 110*a* until its forward end abuts abutting portion 260*a* of receiving member 256*a*, thus attaining the state shown in FIGS. 16 and 17-A. At this time, shaft 272*a* is located at the first angular position at which one of projecting sections 280*a* of positioning member 274*a* is in engagement with stop pin 276*a*. Thus, upon the insertion of cassette 110*a* as described above, cassette linking levers 284*a* fixed to shaft 272*a* are fitted into recesses 248*a* formed in both sides of the forward end portion of cassette 110*a*. The transfer sheet lifting lever 286*a* mounted on shaft 272*a* is locked at a retracted position at which its forward end is substantially on the same plane as cassette bottom guiding portion 258*a* of receiving member 256*a*.

Then, paper supplying cassette 110*a* is turned in a direction in which its forward end inserted in the receiving section moves upwardly. As a result, as shown in FIG. 17-B, notches 253*a* of cassette 110*a* come into engagement with stop plates 270*a* to stop the turning of paper supplying cassette 110*a* by pullspring 278*a* and to prevent its rearward movement. At the same time, with the turning of the paper supplying cassette 110*a*, cassette linking levers 284*a* are turned counterclockwise, and shaft 272*a* is brought to the second position at which the other projecting section 282*a* of positioning member 274*a* is engaged with stop pin 276*a*. Thus, lifting lever 286*a* is unlocked, and by the action of spring 288*a*, is elastically urged counterclockwise, whereby its forward end projects from opening 250*a* of cassette 110*a* and elastically lifts auxiliary bottom plate 244*a* and receptor sheet layer 246*a* in the cassette 110*a* to urge the topmost receptor sheet elastically against paper feed roller 268*a*. Two corners of the forward end of the topmost receptor sheet lifted by lever 286*a* from layer 246*a* come into engagement with blocking members 252*a* to check its upward movement. With these parts and the paper in such a condition, paper feed rollers 268*a* are rotated in the direction of arrow E, the topmost receptor sheet urged elastically against it is delivered toward the transfer station, moved along guide portion 262*a* of receiving member 256*a*, and fed into a receptor sheet conveying system to be described.

When it is desired to take out paper supplying cassette 110*a* from the receiving section after all the receptor sheets in cassette 110*a* have been consumed, cassette 110*a* is turned from the position shown in FIG. 17-B in a direction in which its forward portion moves downward to attain the position shown in FIG. 17-A. Consequently, notches 253*a* of paper supplying cassette 110*a* move away from stop plates 270*a*, and paper supplying cassette 110*a* is in condition for rearward movement. At the same time, with the turning of the paper supplying cassette 110*a*, cassette linking levers 284*a* and shaft 272*a* are turned clockwise, and shaft 272*a* is returned to the first position at which one of projecting sections 280*a* of positioning member 271*a* comes into engagement with stop pin 276*a*. The foremost end of paper supplying cassette 110*a* moving downward causes receptor sheet-lifting lever 286*a* to rotate clockwise and return to its retracted position where it is locked in position. Thereafter, paper supplying cassette 110*a* is moved rearward, and taken out of the receiving section.

In paper supplying cassette 110*a* shown in the drawings, auxiliary bottom plate 244*a* is substantially the same size as the receptor sheet placed on it, and only the forward end portions of auxiliary bottom plate 244*a* and receptor sheet layer 246*a* are lifted by the action of receptor sheet lifting lever 286*a*. Accordingly, the receptor sheet layer 246*a* is inclined at a certain angle. In this case, the angle of the topmost receptor sheet with respect to blocking members 252*a* changes somewhat according to the change in the thickness of receptor sheet layer 246*a*. Hence, the action of blocking members 252*a* on the receptor sheet is somewhat changed, and this may sometimes hamper the action of delivering only the topmost receptor sheet. To cope with this situation, it is possible to utilize auxiliary bottom plate 244*a* which is located only beneath the front half of receptor sheet layer 264*a* and to provide a suitable guide means on the inner surface of each of the two side walls of case 242*a* whereby auxiliary bottom plate 244*a* is lifted while being held substantially parallel to the bottom plate of cassette 110*a* or 110*b* by the action of lifting lever 286*a*. According to this construction, the front half of the receptor sheet layer can be lifted while being held substantially parallel to the bottom plate of cassette 110*a* or 110*b*, and the angle of the topmost receptor sheet with respect to blocking member 252*a* can be maintained substantially constant, and therefore, the action of blocking member 252*a* on the receptor sheet can be maintained in the most suitable condition.

The receptor sheet conveying system 112 will be described in detail below with reference mainly to FIG. 9. Receptor sheet conveying system 112 for conveying a receptor sheet from cassette 110*a* or 110*b* to receiving tray 30 through the transfer station and fixing device 28 consists, for example, of roller pairs 290, 292, 294 and 296 each consisting of a driven roller and an idler roller, a receptor sheet guide plate between the rolls in each pair, and receptor sheet conveying roller 240 and guide plate 42 already described above with reference to FIG. 14. It is of course possible, as described in detail with reference to FIG. 5, to provide electrostatic eliminators 44 and 46 above guide plate 42 and/or above the inside end portion of receiving tray 30 so as to facilitate the conveying of receptor sheets. It is important to construct the receptor sheet conveying system 112 such that paper jamming which occurs at any part of receptor sheet conveyor system 112 can be rapidly and easily corrected. For this purpose, upstream of conveying system 112 for example, the rollers and guide plate defining the underside of the conveying system are mounted on supporting frame 300 pivotably fixed to pin 298 so that should paper jamming occur at this part, support frame 300 can be turned clockwise around pin end 298 as a center to cope with the paper jamming rapidly and easily. Paper jamming which occurs in or near the transfer station can be adjusted easily and rapidly by sliding in the forward direction (the direction perpendicular to the plane of FIG. 9) support 172 having rotary drum 108, developing device 6 and cleaning device 34 mounted on it, as already described. At the most upstream part and the most downstream part of conveying system 112, paper jamming can be adjusted rapidly and easily by first removing the paper supplying cassette 110*a* or 110*b* or receiving tray 30 and reaching through the opening which has been left by the removing of cassette 110*a* or 110*b* or receiving tray 30.

DRIVING SYSTEM

The driving system is now described mainly with reference to FIGS. 18 and 19.

Referring to FIG. 18, in the preferred embodiment of the elastrostatic copying apparatus of this invention, optical system 22, rotary drum 108, developing device 6, cleaning device 34, fixing device 28, and receptor sheet conveying system 112 are driven by main motor DM (see FIG. 9). Main driving twin sprocket 304 is fixed to the output shaft of main motor DM. Around one member of sprocket 304 are wrapped first endless chain 306 and second endless chain 308. First endless chain 306 starts at one member of sprocket 304, extends over driving sprocket 312 for driving optical system 22 for scanning [which sprocket is connected selectively to driven pulley 156 (see FIG. 10) of optical system 22 by a scanning electromagnetic clutch MC1 (see FIG. 20)], sprocket 316 for returning optical system 22 [which sprocket is connected selectively to driven pulley 156 of optical system 22 by return electromagnetic clutch MC2 (see FIG. 20)], linking sprocket 318 equipped with a linking gear, sprocket 320 for driving rotary drum 108 (which sprocket is drivingly connected to shaft 206 of rotary drum 108 as already described with reference to FIG. 15, or drivingly connected to gear 344 of rotary drum 108 via a driven shaft and a gear fixed to it as described above with reference to FIG. 13A) and idle sprocket 322, and returns to the one member of sprocket 304. Second endless chain 308 starts at the other member of sprocket 304, extends around sprocket 324 fixed to one of the shafts of a pair of press rollers for driving fixing device 28, sprocket 326 fixed to one shaft of roller pair 294 for conveying a receptor sheet, idle sprocket 328 and sprocket 330 fixed to one shaft of roller pair 296 for driving receptor sheet conveying rollers, and returns to the other member of sprocket 304. Sprocket 332 equipped with a linking gear is drivingly connected to linking sprocket 318 over which first endless chain 306 is stretched, and third endless chain 334 is wrapped around sprocket 332. Third endless chain 334 starts from sprocket 332, extends around sprocket 336*a* selectively connected to shaft 266*a* of paper feed roller 268*a* by electromagnetic clutch CM3 (see FIG. 20), sprocket 336*b* connected selectively to shaft 266*b* of paper feed roller 268*b* of electromagnetic clutch MC4 (see FIG. 20), idle sprocket 338, sprocket 340 fixed to one shaft of roller pair 390 for driving the receptor sheet conveying rollers and sprocket 342 fixed to one shaft of roller pair 292 for driving the receptor sheet conveying roller, and returns to sprocket 332.

As clearly shown in FIG. 19, gear 344 (see FIG. 15 also) is fixed to rotary drum 108. This gear 344 is drivingly connected to gear 348 fixed to the shaft of developer-holding member 50 of cleaning device 34 via speed increase gear device 346, and also to gear 354 fixed to the shaft of developer-holding member 8 of developing device 6 via speed increase gear device 350 and idle gear 352. A gear (not shown) is fixed to the shaft of receptor sheet conveying roller 240 disposed immediately downstream of the transfer station, and is drivingly connected to idle sprocket 322 via an idle gear.

It will be appreciated therefore that the optical system 22, rotary drum 108, developing device 6, cleaning device 34 and receptor paper sheet conveying system 112 are properly driven by main motor DM.

CONTROL SYSTEM

The control system is described with reference to FIGS. 8, 20 and 24.

Referring to FIG. 8, control panel 106 disposed on the top surface of housing 100 has main switch SW, knob EC for adjusting the amount of exposure, alarm lamp $L_1$ for signalling paper jamming, lamp $L_4$ for paper supply, print button PB, preset counter PC for presetting the number of copies required, and receptor sheet selecting switch $S_8$.

Within housing 100 are disposed at the positions shown in FIG. 20 switch $S_1$ for detecting the return of first support frame 150 having first reflecting mirror 140 mounted thereon to a predetermined position, switch $S_2$ for detecting the movement of first support frame 150 beyond a predetermined position, switches $S_3$ and $S_4$ which cooperatively detect paper jamming, switch $S_2$ for successively starting the supply of receptor sheets when many copies are to be made, and switches $S_6$ and $S_7$ for detecting the presence or absence of a receptor sheet in cassette 110*a* or 110*b*.

Housing 100 also includes various electrical elements such as electromagnetic clutch MC1 for connecting sprocket 312 to pulley 156 of optical system 22, electromagnetic clutch MC22 for connecting sprocket 316 to pulley 156 of optical system 22, electromagnetic clutch MC3 for connecting the sprocket 336*a* to the shaft of paper feed roller 268*a*, electromagnetic clutch MC4 for connecting sprocket 336*a* to the shaft of paper feed roller 268*a*, high voltage transformer HV-1 for corona discharge device 20, high voltage transformer HV-2 for corona discharge device 36, fan motor FM for driving suction blower 130, main motor DM, original illuminating lamp 128 for illuminating an original, and electrostatic eliminator lamp 32.

The electrical elements described hereinabove with reference to FIGS. 8 and 20 are incorporated into the electric circuit shown in FIGS. 21 to 24. The details of the electric circuit itself are believed to be readily understandable from FIGS. 21 to 24, and a description of them is omitted.

The operation of the preferred embodiments of the electrostatic copying apparatus of this invention is described below mainly by reference to FIG. 8 and FIGS. 20 to 24.

When it is desired to copy an original placed on transparent plate 102, main switch SW is turned on. Then, as required, exposure adjusting knob EC is operated to adjust variable resistance VR (FIG. 21) to set the amount of light from lamp 128 at a suitable value. Furthermore, as required, receptor sheet select switch $S_8$ is actuated to select a suitable size (for example, B5 of A4) of receptor sheet to be conveyed through conveying system 112.

Figure 22:
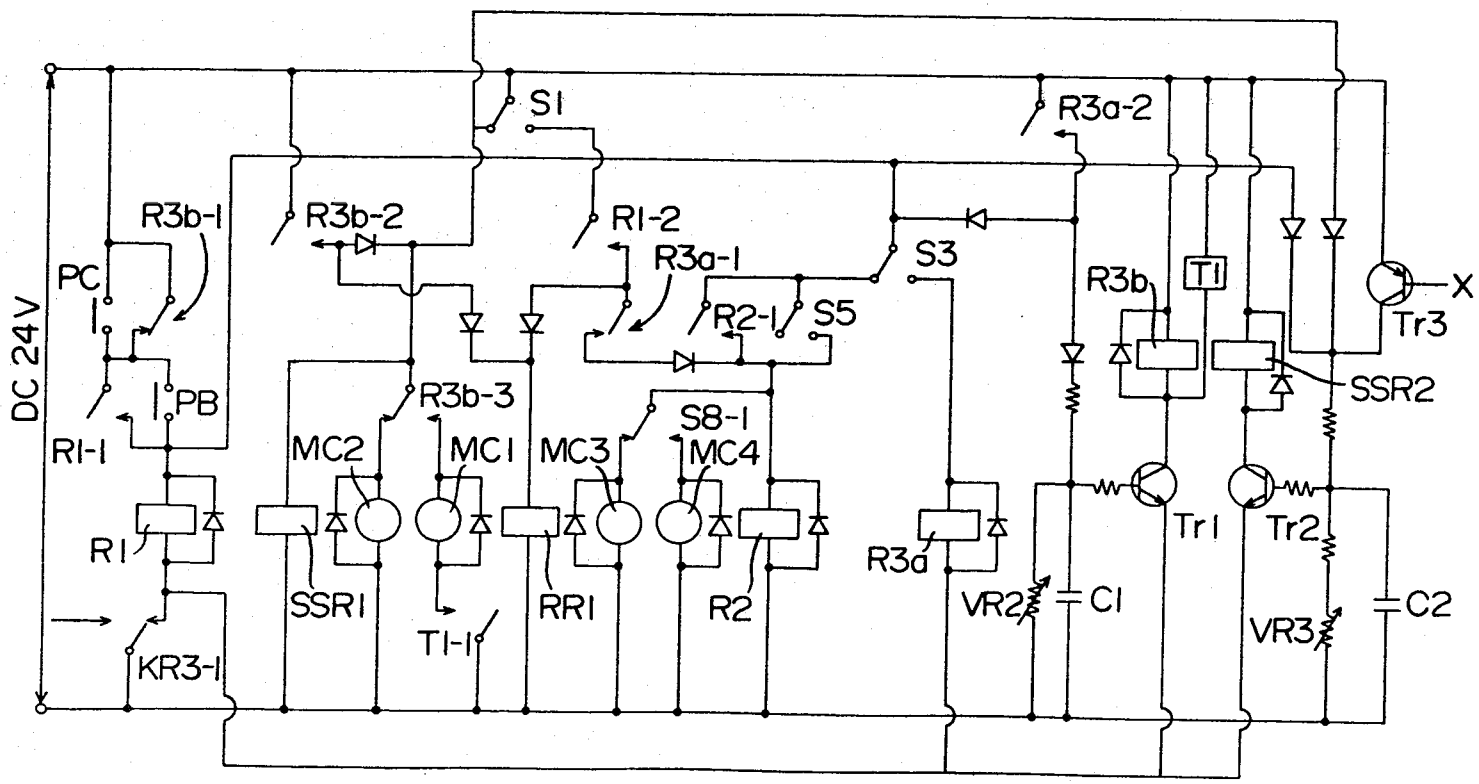

Referring to FIGS. 22 and 23, the selection of a receptor sheet and the detection of a receptor sheet are described. When for example, select switch $S_8$ (FIG. 23) is actuated so as to select a receptor sheet (for example, of B-5 size) in cassette 110*a*, the pressing of print button PB will bring electromagnetic clutch MC3 for connecting the sprocket 336*a* to the shaft of paper feed roller 268*a* into the operative state, as can be understood from FIG. 22. Furthermore, switch $S_{8-1}$ shown in FIG. 22 interlocks with switch $S_8$ whereby indicating lamp $L_2$ provided within the switch $S_8$ change-over operating member on control panel 106 is lighted to indicate the selection of receptor sheet in cassette 110*a*. Switch $S_6$ for detecting the presence or absence of receptor sheet within cassette 110*a* lights paper supply lamp $L_4$ when no receptor sheet is present, and subsequent pressing of print button PB does not actuate relay $R_1$ and thus does not start the copying process. The same operation takes place when select switch $S_8$ is actuated to select a receptor sheet (for example, with a size A-4) in cassette 110*b*.

Assuming that preset counter PC is set at 1 (in which case the terminal of present counter PC is off), the control of the operation of each component part of the electrostatic copying apparatus is summarized as follows:

(i) When first support frame 150 does not return to a predetermined position before the start of the copying process by pressing the print button PB, switch $S_1$ is not pressed but is normally open. Hence, electromagnetic clutch MC2 is energized to return first support frame 150 to the predetermined position.

(ii) When print button PB is pressed, relay $R_1$ is operated and its contacts $R_{1-1}$ and $R_{1-2}$ are closed. Thus, a voltage is applied to the base of transistor $Tr_2$ to actuate relay $SSR_2$ and close its contact $SSR_{2-1}$. Thus, main motor DM and fan motor FM rotate and electrostatic eliminator lamp 32 is lighted. Contact $R_{1-1}$ self-maintains relay $R_1$. Contact $R_{1-2}$ actuates relay $R_2$ and relay $RR_1$ to light the original illuminating lamp 128 and to energize electromagnetic clutch MC3 (or MC4), thus starting paper supply.

(iii) When the forward end of a receptor sheet fed from paper cassette 110*a* (or 110*b*) presses switch $S_3$ disposed in receptor sheet conveying system 112, relay $R_{3a}$ is actuated and its contacts $R_{3a\text{-}2}$ and $R_{3a\text{-}3}$ are closed. When contact $R_{3a\text{-}1}$ is open, relay $R_2$ is also open and electromagnetic clutch MC3 (or MC4) is deenergized. When contact $R_{3a\text{-}2}$ is closed, condenser $C_1$ is charged, and upon completion of charging, a voltage is applied to transistor $Tr_1$ to close relay $R_{3b}$ and timer $T_1$. The time during which transistor $Tr_1$ is kept in operation by the charge generated in condenser $C_1$ is determined by the time constant of a CR circuit of condenser $C_1$ and variable resistance $VR_2$. Contact $R_{3a\text{-}3}$ actuates high voltage transformer HV-1 for corona discharge device 20. When relay $R_{3b}$ operates, its contact $R_{3b\text{-}1}$ is opened and releases the self-maintaining of $R_1$. Furthermore, when contact $R_{3b\text{-}2}$ is closed, $SSR_1$ is closed to actuate high voltage transformer HV-2 for corona discharge device 36. Contact $R_{3b\text{-}3}$ serves to perform changeover between electromagnetic clutch MC1 and electromagnetic clutch MC2, and is connected to electromagnetic clutch MC1 when it is closed.

(iv) Timer $T_1$ is an on-delay timer, and after a lapse of a certain period of time that can be suitably prescribed from the time of actuation of $R_{3a}$, its contact $T_{1\text{-}1}$ is closed. When $T_{1\text{-}1}$ is closed, magnetic clutch MC1 is energized to move first support frame 150 and second support frame 152 forward (scanning movement).

Specifically, after a certain period of time preset by timer $T_1$ from the time when the forward end of a receptor sheet fed from cassette 110*a* or 110*b* has engaged switch $S_2$ disposed on receptor sheet conveying system 112, first support frame 150 and second support frame 152 begin to move forward, and therefore, optical system 22 begins to scan the original placed on transparent plate 102 and to project the image of the original onto the surface of rotary drum 108. Accordingly, by properly adjusting the time to be set by timer $T_1$, the forward end of the image of the original projected onto the surface of rotary drum 108 can be accurately registered with the forward end of a receptor sheet fed from paper supplying cassette 110*a* (or 110*b*).

This registration can also be performed by a mechanical element provided adjustably on receptor sheet conveying system 112 and adapted to be operated by the forward end of receptor sheet. One example of such a mechanical element is shown in FIG. 25. In this embodiment, instead of timer $T_1$ and switch $S_3$, detecting member 606 is provided which serves to sense the forward end of receptor sheet between upper guide plate 602 and lower guide plate 604 forming part of the receptor sheet conveying system 112 between roller pair 290 and roller pair 292. This detecting member 606 at a part near its one end is rotatably supported by rear vertical base plate 103, and at a part near its other end, rotatably supported by bracket 608. Bracket 608 is adjustably mounted on upper guide plate 602 for adjustment in the receptor sheet conveying direction 610 by a screw which extends through elongated slot 612 extending in the receptor sheet conveying direction 610 and is screwed up under guide plate 602. One end 606*a* of detecting member 606 projects beyond rear vertical base plate 103 and contacts an actuator for microswitch 614. The other end 606*b* of detecting member 606 passes through opening 616 formed in upper guide plate 602, extends to receptor sheet conveying system 112 between upper guide plate 602 and lower guide plate 604, and further projects past opening 618 formed in lower guide plate 604. Detecting member 606 is rotated clockwise in FIG. 25 when the forward end of receptor sheet that is conveyed through conveying system 112 comes into engagement with other end 606*b*, and its one end 606*a* actuates microswitch 614. When microswitch 614 is operated, electromagnetic clutch MC1 is energized to start the forward movement of first support frame 150 and second support frame 152. Hence, optical system 22 begins to scan the original placed on transparent plate 102 and to project the image of the original onto the surface of rotary drum 108. The forward end of the image projected onto the surface of rotary drum 108 and the forward end of the receptor sheet can be properly registered by changing the fixing position of bracket 608 to move detecting member 606 in the direction of arrow 620 with a part of detecting member 606 which is near the rear vertical base plate 103 being used as a fulcrum, and thus properly adjusting the sensing position of other end 606*b* of detecting member 606. Preferably, a plurality of protruding portions 622 are provided in the widthwise direction at spaced intervals on the top surface of bottom guide plate 604 so as to bring the forward end of receptor sheet into exact engagement with other end 606*b* of detecting member 606 and to facilitate smooth conveying of the receptor sheet.

(v) When the rear end of the receptor sheet moving on the receptor sheet conveying system 112 passes $S_3$, the pressing of $S_3$ is released to set relay $R_{3a}$ off, and its contact $R_{3a\text{-}1}$ is closed and contacts $R_{3a\text{-}2}$ and $R_{3a\text{-}3}$ are opened. When $R_{3a\text{-}3}$ is off, the operation of high voltage transformer HV-1 for corona discharge device 20 is stopped. On the other hand, condenser $C_1$ is still charged after $R_{3a\text{-}2}$ is opened. Thus, until the charge in condenser $C_1$ dissipates, transistor $T_{r1}$ operates to keep relay $R_{3b}$ in operation.

(vi) When the charge in condenser $C_1$ is discharged to a predetermined voltage level, relay $R_{3b}$ is deenergized, and its contact $R_{3b\text{-}2}$ is opened. When $R_{3b\text{-}2}$ is off, $SSR_1$ and $RR_1$ are opened to stop the operation of high voltage transformer HV-2 for corona discharge device 36 and light the lamp 128. Furthermore, the connection of contact $R_{3b\text{-}3}$ is switched from the MC1 side of the MC2 side to move first support frame 150 and second support frame 152 backward (return movement).

(vii) When first support frame 150 moves backward and presses switch $S_1$ provided at its stopping position, switch $S_1$ is turned off. Accordingly, electromagnetic clutch MC2 is reset to stop first support frame 150 and second support frame 152.

(viii) When the rear end of the receptor sheet moving on conveying system 112 leaves switch $S_4$ (FIG. 24), switch $S_4$ is turned off and KR2-R of keep relay KR2 actuates to close KR2-1 and ground the collector of transistor $Tr_3$. Thus, the application of a voltage from line X is stopped and transistor $Tr_3$ becomes inoperative. $Tr_2$, however, is still in the operative state because of the charge on condenser $C_2$. When the charge on condenser $C_2$ falls to a predetermined voltage level, $Tr_2$ becomes inoperative. As a result, relay SSR2 maintained in the closed state by contacts $R_{1\text{-}1}$ and $R_{3b\text{-}2}$ and transistor $Tr_3$ is opened to stop main motor DM and fan motor FM and turn off eliminator lamp 32. The time during which $Tr_2$ is maintained operative by the charge on condenser $C_2$ is determined by the time constant of a CR circuit of condenser $C_2$ and variable resistance $VR_3$.

$VR_3$ is adjusted so that $Tr_2$ becomes inoperative when the receptor sheet after the departure of its rear end from switch $S_4$ has been completely discharged into the receiving tray.

When first support frame 150 and second support frame 152 keep moving foward even after $R_{3b}$ is off, switch $S_2$ for sensing the overrunning of first support frame 150 is pressed by first support frame 150 and actuates $KR_3$-L of keep relay $KR_3$ thereby to stop the copying process.

When preset counter PC is set at more than one copy, its terminal is turned on and so maintained until the remaining number becomes one. When the remaining number is one, the terminal is turned off. When preset counter PC is on, the first support frame 150 presses switch $S_5$ during its backward movement (return movement) to turn on switch $S_5$ and thereby actuate relay $R_2$. Consequently, its contact $R_{2-1}$ is closed to energize electromagnetic clutch MC3 (or MC4) and to start paper supply. When the forward end of receptor sheet supplied from cassette 110*a* or 110*b* presses switch $S_3$, relay $R_{3a}$ is actuated and its contact $R_{3a-1}$ is opened. Furthermore, relay $R_2$ is opened to deenergize the electromagnetic clutch MC3 (or MC4). Also, $R_{3a-2}$ and $R_{3a-3}$ are closed. When $R_{3a-2}$ is on, a charge is generated on condenser $C_1$ and transistor $Tr_1$ is actuated. $R_{3b}$ is also closed and its contact $R_{3b-2}$ is closed. Thus, relay RR1 is actuated to light original-illuminating lamp 128.

Sensing of paper jamming in receptor sheet conveying system 112 is described with particular reference to FIG. 24.

The basic theory of sensing paper jamming is that the time tc from the sensing of the rear end of receptor sheet by switch $S_3$ to the sensing of the rear end of the same receptor sheet by switch $S_4$ and the time tt preset by on-delay timer $T_2$ are set in a relation $tc<tt$, and the operation of the apparatus is stopped and alarm lamp $L_1$ is lighted when paper jamming causes the relation $tc<tt$. When the forward end of the receptor sheet presses switch $S_3$, relay 3a actuates to close its contact $R_{3a-4}$. As a result, transistor $Tr_5$ becomes operative, and condenser $C_3$ is charged. However, KR2-L does not operate since the high voltage side of KR2-L is simultaneously off. When the rear end of the receptor sheet has passed switch $S_3$, the pressing of $S_3$ is released to open $R_{3a-4}$ and set the high voltage side in operation. Since transistor $Tr_5$ is operative for a certain period of time because of the charge on condenser $C_3$, KR2-L operates and its contact KR2-1 is closed thereby to actuate timer $T_2$ (when there is an input into timer $T_2$, its contact $T_{2-1}$ is closed after a preset time, and when the input is cut off before the preset time elapses, timer $T_2$ returns to the original state). When receptor sheet is conveyed normally, switch $S_4$ senses the rear end of the receptor sheet before the expiration of the time preset by timer $T_2$ to actuate KR2-R. Accordingly, contact $KR_{2-1}$ is opened to stop the operation of timer $T_2$. When KR2-R does not actuate, contact $T_{2-1}$ of timer $T_2$ is closed after the preset time to actuate KR2-L and open its contact $KR_{3-1}$. Accordingly the actuation of relay SSR2 stops and the operation of the apparatus stops. At the same time alarm lamp $L_1$ is lighted. The keep relays KR2 and KR3 operate by one pulse and self-maintain mechanically, and even when the power supply is cut off, the self-maintaining condition remains. The self-maintaining condition may be released by applying a signal to another input terminal (reset coil). In resuming the operation of the apparatus after proper correction of paper jamming, it is necessary to operate reset switch RS which is provided for releasing the self-maintaining condition of the relays.

What is claimed is:

1. An electrostatic copying process which comprises (1) the step of forming an electrostatic latent image on the surface of a photosensitive member having a photoconductive layer, (2) the step of developing the electrostatic latent image by applying a monocomponent developer composed of a conductive or semiconductive fine magnetic powder to the electrostatic latent image to form a toner image on the surface of the photosensitive member, (3) the step of transferring the toner image by conveying a receptor sheet to a transfer station and successively contacting the surface of the photosensitive member closely with the surface of the receptor sheet at the transfer station to transfer the toner image to the surface of the receptor sheet, (4) the step of fixing the toner image by separating the receptor sheet from the surface of the photosensitive member and fixing the toner image transferred onto the surface of the receptor sheet, (5) the step of eliminating electrostatic charge from the photosensitive member by irradiating the surface of the photosensitive member with an electrostatic eliminating lamp after the toner image has been transferred to the receptor sheet, and (6) the step of cleaning the surface of the photosensitive member by removing the developer remaining on the surface of the photosensitive member after the electrostatic charge eliminating step, said step of removing the developer being carried out by providing a developer-holding member, magnetically holding the same kind of developer as used in the developing step on the surface of said developer-holding member by providing a stationary magnet disposed within the developer-holding member, moving the surface of the developer-holding member in a direction opposite to the moving direction of the surface of the photosensitive member while contacting the two surfaces through the layer of the developer, whereby the surface of the photosensitive member is mechanically brushed by the layer of the developer, said developer-holding member being a rotatable hollow cylindrical sleeve, said magnet being a roll-like permanent magnet having a plurality of magnetic poles, and one of the magnetic poles which is located most closely to a position at which the surface of the developer-holding member is closest to the surface of the photosensitive member being positioned, during cleaning, downstream in the rotation direction of the developer-holding member by a certain angle with respect to the position at which the two surfaces are closest to each other.

2. The process of claim 1 wherein said rotatable hollow cylindrical sleeve has an insulating surface coating.

3. The process of any one of claims 1 or 2 further comprising controlling the thickness of the developer layer held on the surface of the developer-holding member by adjusting the position of a brush length adjusting member having the forward end approximately the shape of the surface of the developer-holding member and which is positioned downstream in the moving direction of the surface of the developer-holding member, of the area in which the surface of the developer-holding member is contacted with the surface of the photosensitive member through the developer layer for making the distance $d_5$ between the forward end of the brush length adjusting member and the surface of the developer-holding member 0.6–0.25 mm, and the distance $d_4$ between the surface of the electrostatic latent image-bearing member and the surface of the developer-holding member at a position at which they are closest to each other from about 1.2–0.5 mm.

* * * * *